US007273241B2

(12) United States Patent
Milo

(10) Patent No.: US 7,273,241 B2
(45) **Date of Patent: *Sep. 25, 2007**

(54) DOOR LATCH ACTUATOR

(75) Inventor: Thomas K. Milo, Akron, OH (US)

(73) Assignee: T.K.M. Unlimited, Inc., Akron, OH (US)

( * ) Notice: Subject to any disclaimer, the term of this patent is extended or adjusted under 35 U.S.C. 154(b) by 216 days.

This patent is subject to a terminal disclaimer.

(21) Appl. No.: 10/782,690

(22) Filed: Feb. 19, 2004

(65) Prior Publication Data

US 2005/0184539 A1 Aug. 25, 2005

(51) Int. Cl.
*E05B 15/02* (2006.01)

(52) U.S. Cl. ..... 292/341.15; 70/279.1

(58) Field of Classification Search ..... 292/341.16, 292/341.17, 341.15; 70/279, 279.1
See application file for complete search history.

(56) References Cited

U.S. PATENT DOCUMENTS 4,679,834 A * 7/1987 Gotanda ..... 292/169.13
5,474,342 A * 12/1995 Smith et al. ..... 292/254
6,022,056 A * 2/2000 Cope et al. ..... 292/144
6,082,791 A * 7/2000 Frolov et al. ..... 292/341.16
6,299,225 B1 * 10/2001 Chang ..... 292/341.16
6,568,726 B1 * 5/2003 Caspi et al. ..... 292/341.16
6,580,355 B1 6/2003 Milo
6,581,991 B2 * 6/2003 Galindo ..... 292/341.16

OTHER PUBLICATIONS

Securitron brochure, copyright 2001.

* cited by examiner

*Primary Examiner*—Gary Estremsky
(74) *Attorney, Agent, or Firm*—Fay Sharpe LLP

(57) ABSTRACT

A door latch actuator includes a housing, a latch bolt pin actuator, and a spring latch bolt actuator. The housing includes a strike plate defining a latch opening. The latch bolt pin actuator is mounted for movement in the housing between a first extended position and a second retracted position. The spring latch bolt actuator is mounted for movement in the housing between an extended position and a retracted position.

20 Claims, 28 Drawing Sheets

DOOR LATCH ACTUATOR

BACKGROUND OF THE INVENTION

A door latch actuator can be used to open a door's typical deadlatch lock assembly that includes a spring latch bolt and a latch bolt pin. To "lock" the deadlatch lock assembly, the spring latch bolt is extended and the latch bolt pin is retracted. To "unlock" the deadlatch lock assembly, both the spring latch bolt and the latch bolt pin are retracted. To move from "lock" to "unlock" the latch bolt pin must extend while the spring latch bolt is extended, the "intermediate" position. Next, both the spring latch bolt and the latch bolt pin must retract together.

SUMMARY OF THE INVENTION

A door latch actuator includes a housing, a spring latch bolt actuator and a latch bolt pin actuator. The housing includes a strike plate defining a latch opening dimensioned to receive a spring latch bolt and a latch bolt pin of an associated door deadlatch lock assembly. The spring latch bolt actuator is movably mounted in the housing such that at least a portion of the spring latch bolt actuator moves in and out of the latch opening. The spring latch member can be biased away from the latch opening. The latch bolt pin actuator is movably mounted in the housing such that at least a portion of the latch bolt pin actuator moves in and out of the latch opening.

A door latch actuator includes a housing, a latch bolt pin actuator, and a spring latch bolt actuator. The housing includes a strike plate defining a latch opening. The latch bolt pin actuator is mounted for linear movement in the housing between a first extended position and a second retracted position. The spring latch bolt actuator is mounted for pivotal movement in the housing between an extended position and a retracted position.

A door latch actuator includes a housing, a spring latch bolt actuator, and a latch bolt pin actuator. The housing includes a strike plate defining a latch opening. The spring latch bolt actuator is movably mounted to said housing such that the spring latch bolt actuator moves between a first position wherein the spring latch bolt actuator is retracted in the housing and a second position wherein the spring latch bolt actuator is extended into the latch opening. The latch bolt pin actuator is movably mounted to the housing such that the latch bolt pin actuator moves between a first position wherein the latch bolt pin actuator is retracted in the housing and a second position wherein the latch bolt pin actuator is extended into the latch opening. At least one of the latch bolt pin actuator and the spring latch actuator can at least substantially cover the entire latch opening when at least one of the latch bolt pin actuator and the spring latch actuator is in the extended position.

DETAILED DESCRIPTION OF THE INVENTION

Figure 1:
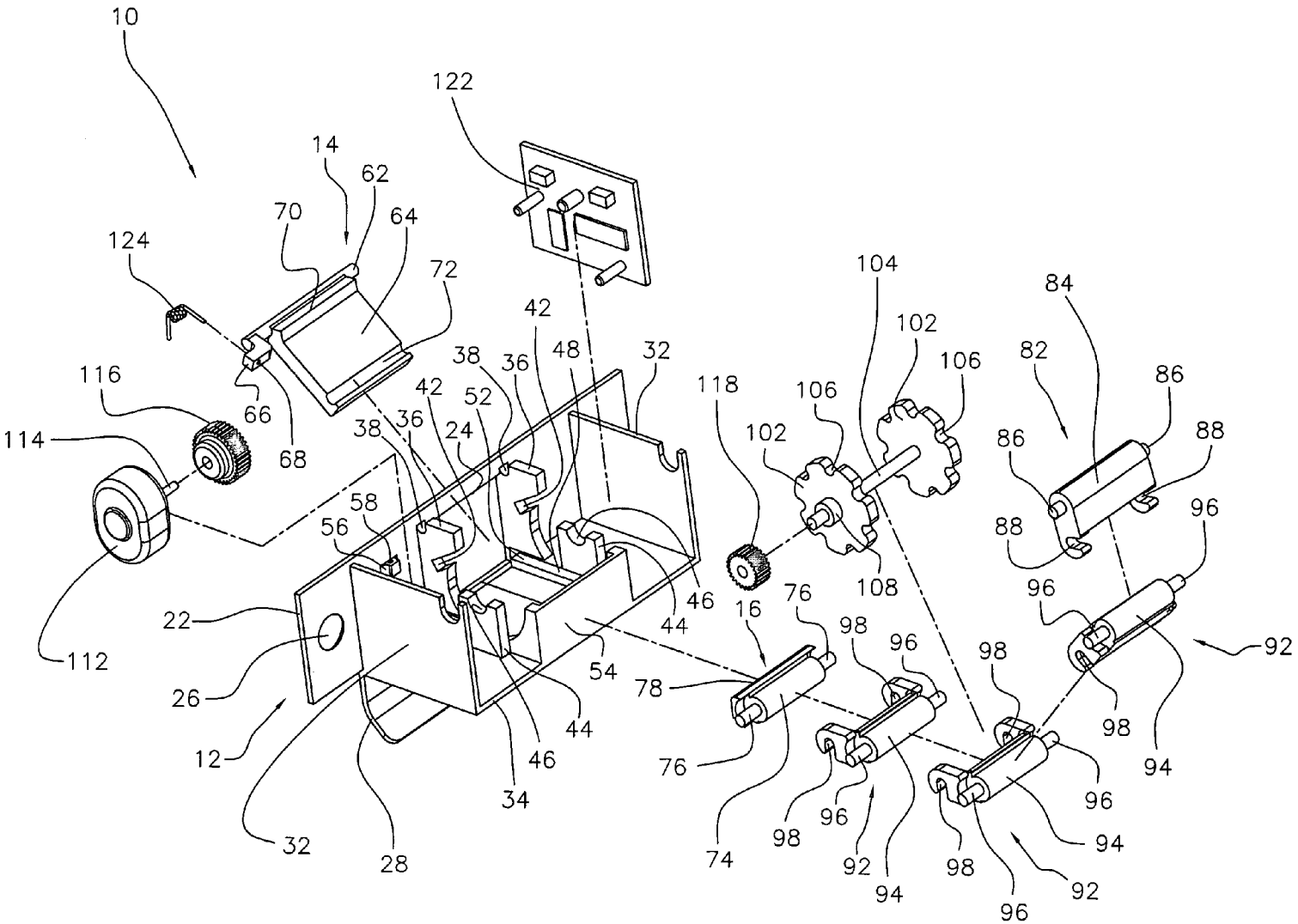
FIG. 1 is an exploded view of a door latch actuator according to a first embodiment.

With reference to FIG. 1, a door latch actuator 10 includes a housing 12, a spring latch bolt actuator 14 and a latch bolt pin actuator 16. The housing 12 of the door latch actuator includes a strike plate 22, which defines a latch opening 24 and fastener openings 26. A strike lip 28 extends outwardly from the strike plate. The latch opening 24 is dimensioned to receive a spring latch bolt and a corresponding latch bolt pin from an associated deadlatch lock assembly. The fastener openings 26 are adapted to receive conventional fasteners that allow the housing 12 to be mounted to an associated conventional door jamb. The strike lip 28 is shaped similarly to a conventional strike lip.

Outermost lateral walls 32 extend from a rear surface of the strike plate 22. A longitudinal wall 34 also extends from the rear surface of the strike plate 22 and connects the outermost lateral walls 32. The longitudinal wall 34 is spaced from the latch opening 24, such that the longitudinal wall does not intersect the latch opening so that the spring latch bolt and latch bolt pin can be received in the latch opening. Intermediate lateral walls 36 extend from the rear side of the strike plate 22 at the upper and lower sides (in reference to the housing being mounted in the door jamb) of the latch opening 24. The intermediate lateral walls 36 include bearing notches 38 disposed on an end of each lateral wall adjacent the rear surface of the strike plate 22. The intermediate lateral walls 36 also include receiving notches 42 spaced from the bearing notches 38 toward the longitudinal wall 34. The housing 12 can include additional outer walls that are not shown to enclose the components of the door latch actuator 10 that will be described in more detail below.

Spaced from the intermediate lateral walls 36 and extending from the longitudinal wall 34, a pair of mounting supports 44 align with the intermediate lateral walls 36 respectively. The mounting walls 44 each include a rounded bearing surface 46. The longitudinal wall 34 also defines two riding surfaces 48 (only one visible in FIG. 1) and notches 52 (only one visible in FIG. 1) disposed underneath each of the intermediate lateral walls 36. A rear wall 54 extends from the longitudinal wall 34 spaced from the latch opening 24, nearly spanning the distance between the mounting walls 44. A projection 56 extends from the rear surface of the strike plate 22. The projection includes an opening 58.

Figure 5:
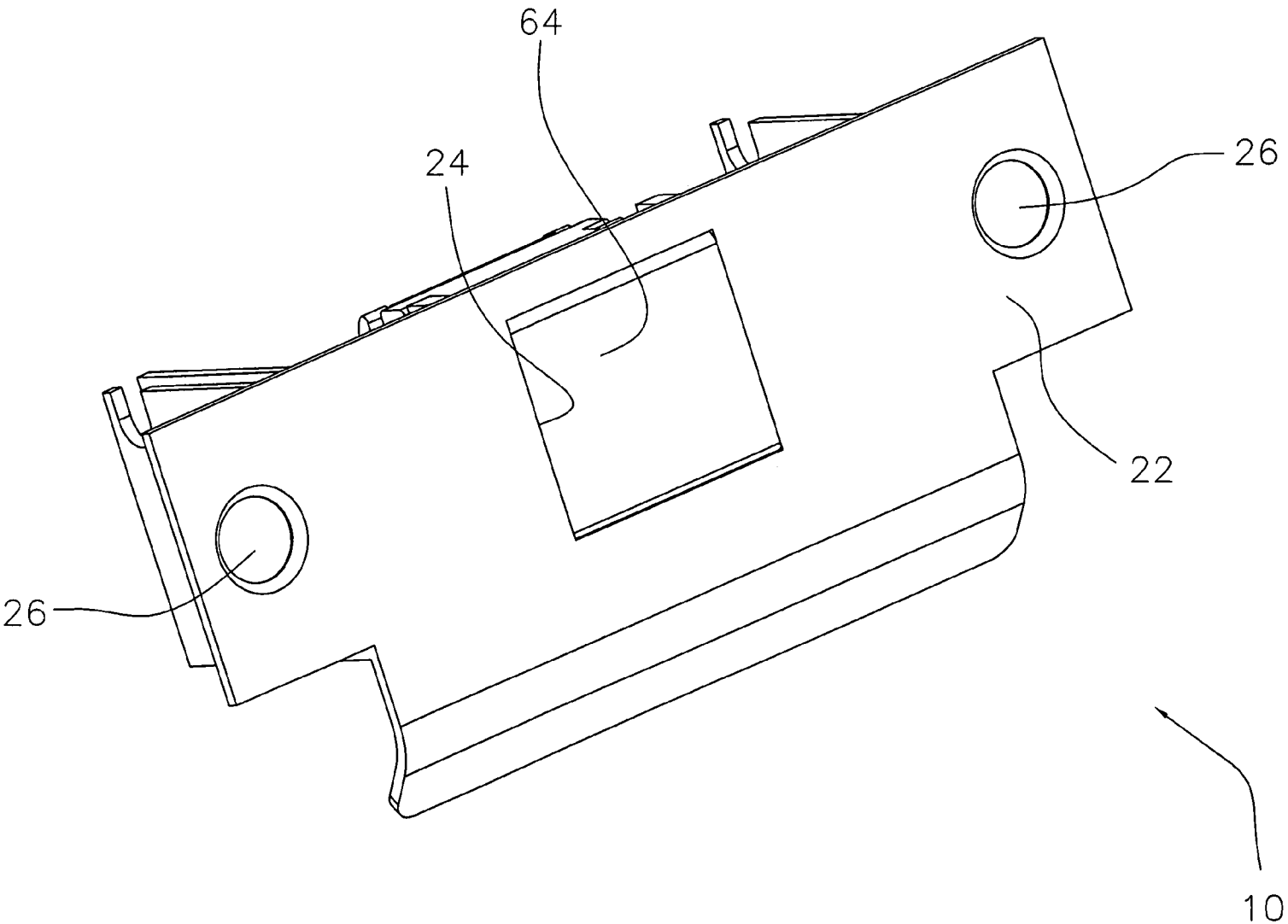
FIG. 5 is a front perspective view of the assembled door latch actuator of FIG. 1 in a second position.

The spring latch bolt actuator 14 moves at least the spring latch bolt of the deadlatch lock assembly to a retracted position from an extended position. The spring latch bolt actuator includes an integral axle 62 attached to an end of a door 64. The door 64 is similarly shaped to the latch opening 24 so that the door can cover the entire latch opening 24, as seen in FIG. 5. An L-shaped appendage 66 depends from the axle 62. The appendage 66 includes an opening 68. An abutment 70 extends from a rear surface of the door 64 near the axle 62. A notch 72 is disposed on the rear surface of the door 64 spaced at an opposite end of the door as the abutment 70. The abutment 70 and the notch 72 run the width of the door 64. The abutment 70 contacts a longitudinal wall (not shown) opposite the longitudinal wall 34 to limit further retraction of the door 64 in the housing 12. The axle 62 is received in the bearing notches 38 of the intermediate lateral walls 36. The spring latch bolt actuator 14 can rotate about the axle 62 to open and close the latch opening 24, which will be described in more detail below.

The latch bolt pin actuator 16 moves or allows the movement of the latch bolt pin of the deadlatch lock assembly. The latch bolt pin actuator includes a cylindrical body 74 having concentric cylindrical extensions 76 protruding from the ends of the cylindrical body, and a blade 78 attached to the radial surface of the cylindrical body. A lower notch 80 (FIG. 3) is formed in a front surface of the blade 78. The notch 80 receives a portion of the strike plate 22 when the spring latch bolt actuator 16 is positioned with its front surface in the latch opening 24 flush with the front surface of the strike face 22, as seen in FIG. 4.

A spring latch bolt actuator ram 82 moves the spring latch bolt actuator 14. The spring latch bolt actuator ram 82 includes a body 84 having concentric cylindrical extensions 86 extending from the body and a pair of hooks 88 attached to the body. A plurality of links 92 connect the latch bolt pin actuator 16 to the spring latch bolt actuator ram 82. Each link 92 includes a substantially cylindrical body 94 having cylindrical extensions 96, similar to the cylindrical extensions 76 and 86, and hooks 98, similar to the hooks 88. The hooks 98 of the link 92 adjacent the latch bolt pin actuator 16 receive the cylindrical extensions 76 of the latch bolt pin actuator. The hooks 98 of the remaining two links 92 receive the cylindrical extensions 96 of the preceding link. The hooks 88 of the spring latch bolt actuator ram 82 receive the cylindrical extensions 96 of the preceding link 92. Accordingly, the latch bolt pin actuator 16 is attached through a plurality of links 92 to the spring latch bolt actuator ram 82.

Two sprocket wheels 102 are spaced from one another and concentrically attached to one another by an axle 104. Each sprocket wheel 102 includes a plurality of recesses 106, each adapted to receive the cylindrical extensions 76, 86 and 96. Bushings 108 (only one visible in FIG. 1) receive the axle 104 on outer sides of the sprocket wheels 102. The bushings 108 rest on the rounded bearing surfaces 46 of the mounting supports 44.

A motor 112 is received in the housing 12 interposed between one of the outermost lateral walls 32 and an adjacent intermediate lateral wall 36. The motor 112 includes a drive shaft 114 which drives a pinion 116. The pinion 116 drives a gear 118 received on the axle 104 of the sprocket wheels 102. The motor and drive gear assembly move the sprocket wheels 102 to move the spring latch bolt actuator 14 and the latch bolt pin actuator 16. The motor receives power from an associated AC and/or DC power source; however, the motor can receive power from another power source, for example batteries, solar power and the like.

Figure 2:
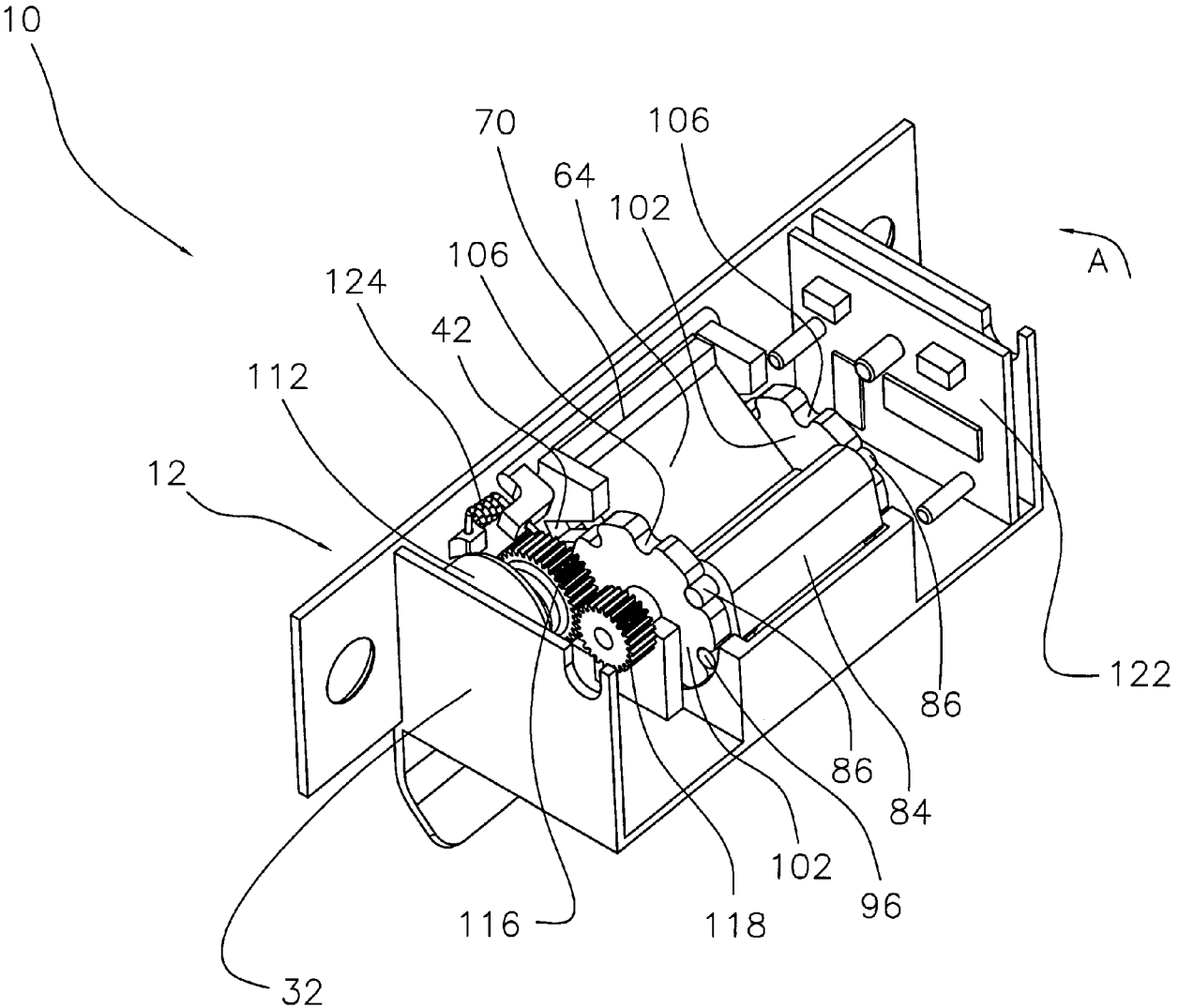
FIG. 2 is a rear perspective view of the assembled door latch actuator of FIG. 1 in a first position.
Figure 3:
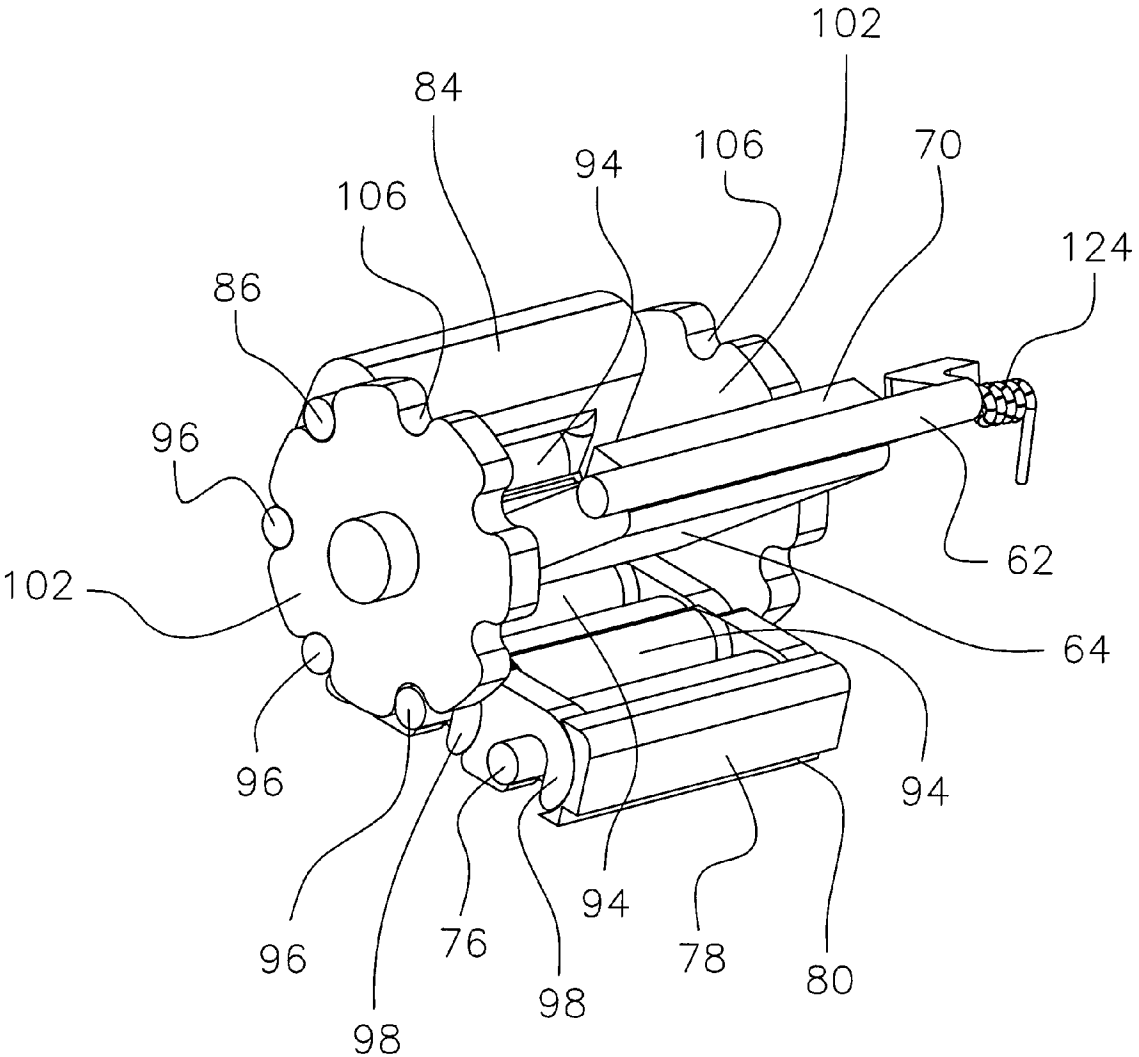
FIG. 3 is a front perspective view of the inner components of the assembled door latch actuator of FIG. 1 in a first position, with the housing removed.
Figure 4:
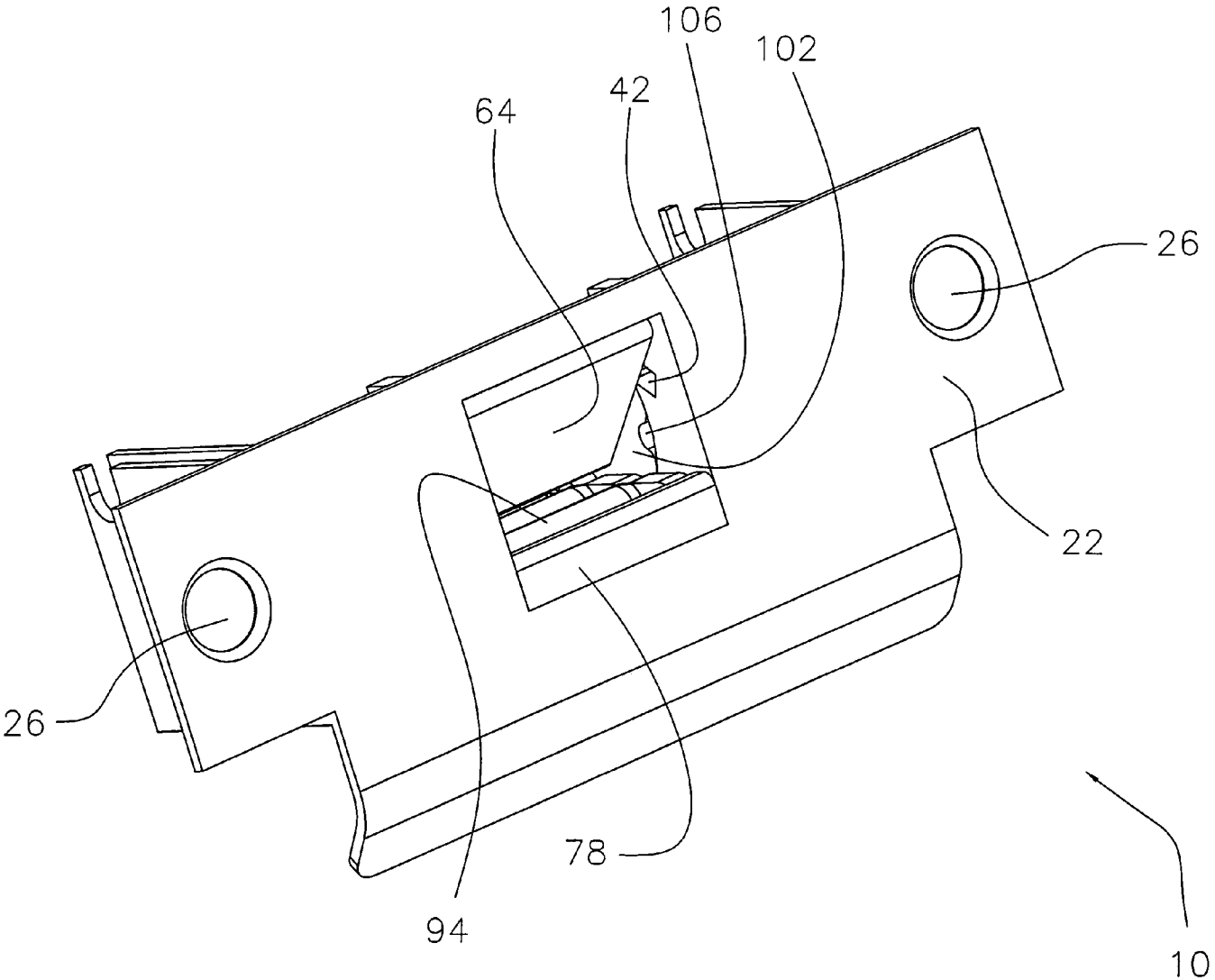
FIG. 4 is a front perspective view of FIG. 2.

In a first position of the door latch actuator, as seen in FIGS. 2, 3 and 4, a front surface of the blade 78 of the latch bolt pin actuator 16 is substantially flush with a front surface of the strike plate 22. This allows the latch bolt pin actuator 16 to depress the latch bolt pin of the deadlatch lock assembly into a retracted position. The door 64 of the spring latch bolt actuator 14 is positioned inside the housing 12, allowing the deadlatch lock assembly's spring latch bolt to extend into the latch opening 24. A spring 124 which is received in the opening 58 of the projection 56 on the housing 12 and the opening 68 of the L-shaped appendage 66 of the door 64 biases the spring latch bolt actuator 14 back into the housing 12 and away from the latch opening 24. With the latch bolt pin of the deadlatch lock assembly in a retracted position and the spring latch bolt of the deadlatch lock assembly in an extended position, the deadlatch lock assembly is "locked."

The motor 112 rotates the pinion 116 causing the gear 118 to rotate in the direction of arrow A (FIG. 2). Rotation of the sprocket wheel 102 moves the latch bolt pin actuator 16 out of the latch opening 24. The cylindrical extensions 76 move linearly along the riding surface 48 moving out of the notch 52 below each intermediate wall and towards the rear wall 54 of the housing. Moving the latch bolt pin actuator 16 out of the latch opening 24 allows the latch bolt pin of the deadlatch lock assembly to move from a retracted position to an extended position so that the deadlatch lock assembly is in an "intermediate" position.

Figure 6:
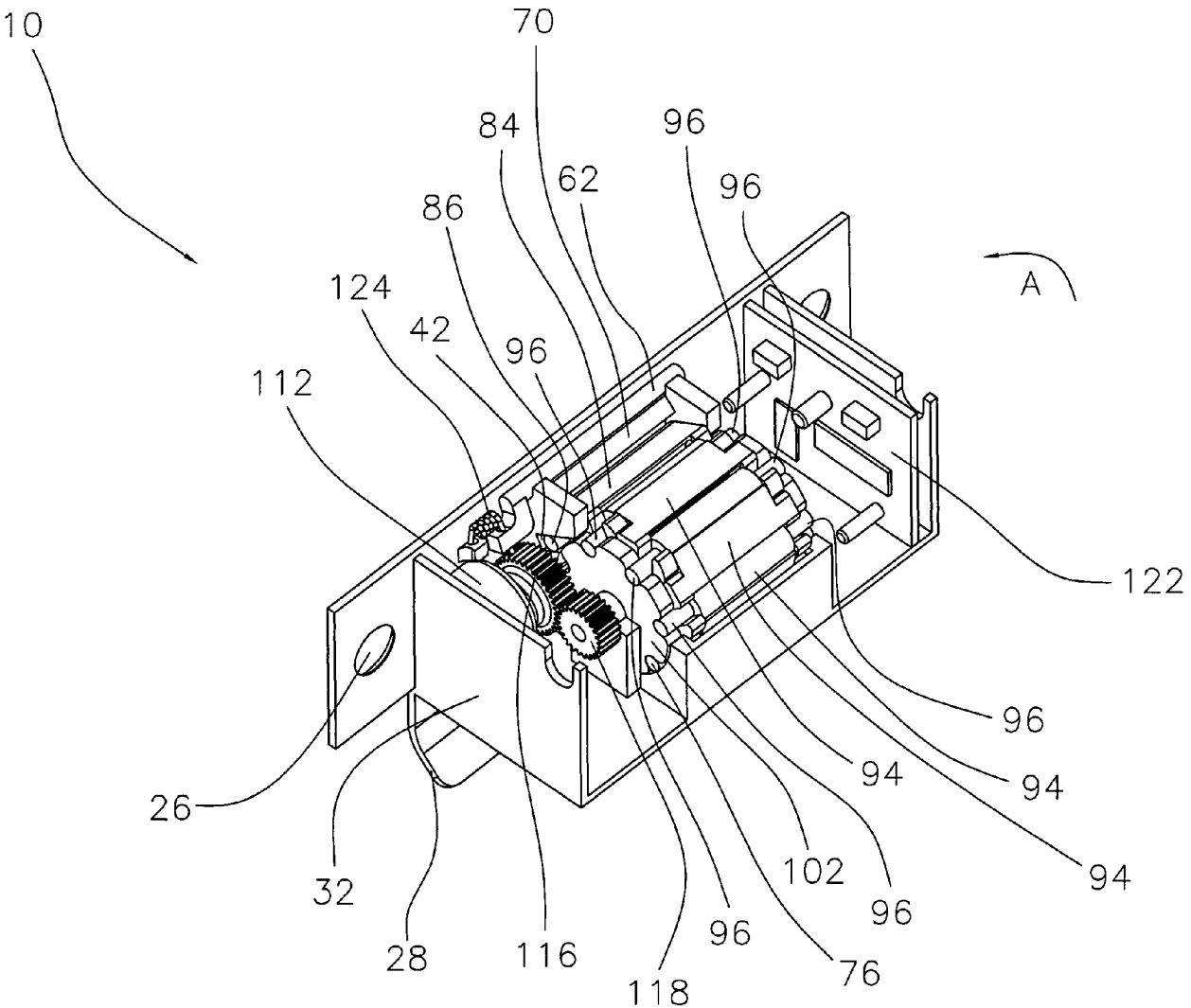
FIG. 6 is a rear perspective view of FIG. 5.
Figure 7:
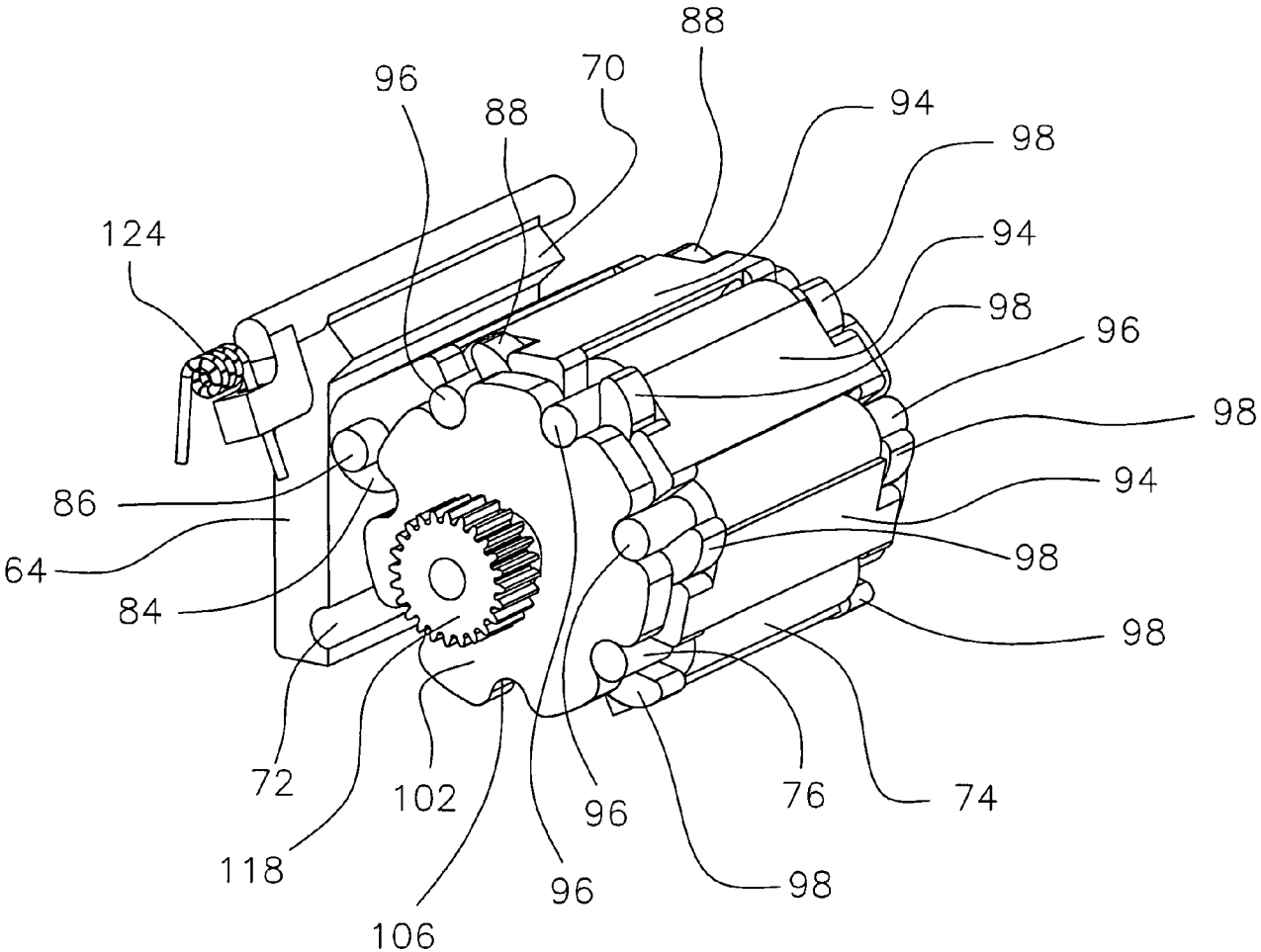
FIG. 7 is a rear perspective view of the inner components of the assembled door latch actuator of FIG. 1 in the second position with the housing removed.

With reference to FIGS. 6 and 7, the rotation of the sprocket wheels 102 also causes the body 84 of the spring latch bolt actuator ram 82 to contact the rear surface of the door 64 of the spring latch bolt actuator 14. The sprocket wheels 102 continue to rotate as the cylindrical extensions 86 of the spring latch bolt actuator ram 82 are received in the receiving notches 42 of the intermediate side walls 36. With reference to FIG. 5, the front side of the door 64 of the spring latch bolt actuator 14 covers the latch opening 24 of the strike plate 22 and the latch bolt pin actuator 16 is now retracted inside the housing 12. Accordingly, the spring latch bolt of the deadlatch lock assembly is retracted along with the dead latch pin so that now the door is "unlocked."

A circuit board 122 can be provided to control the motor. Switches, such as limit switches, can be provided on or remotely connected to the circuit board to control the motor, through conventional circuitry, to move the sprocket wheels 102 accordingly. In an alternative embodiment, the circuit board can include sensors that can detect the location of the sprocket wheels, for example the sprocket wheels can include a mechanism that can emit a signal that is detected by a sensor on the circuit board.

Figure 8:
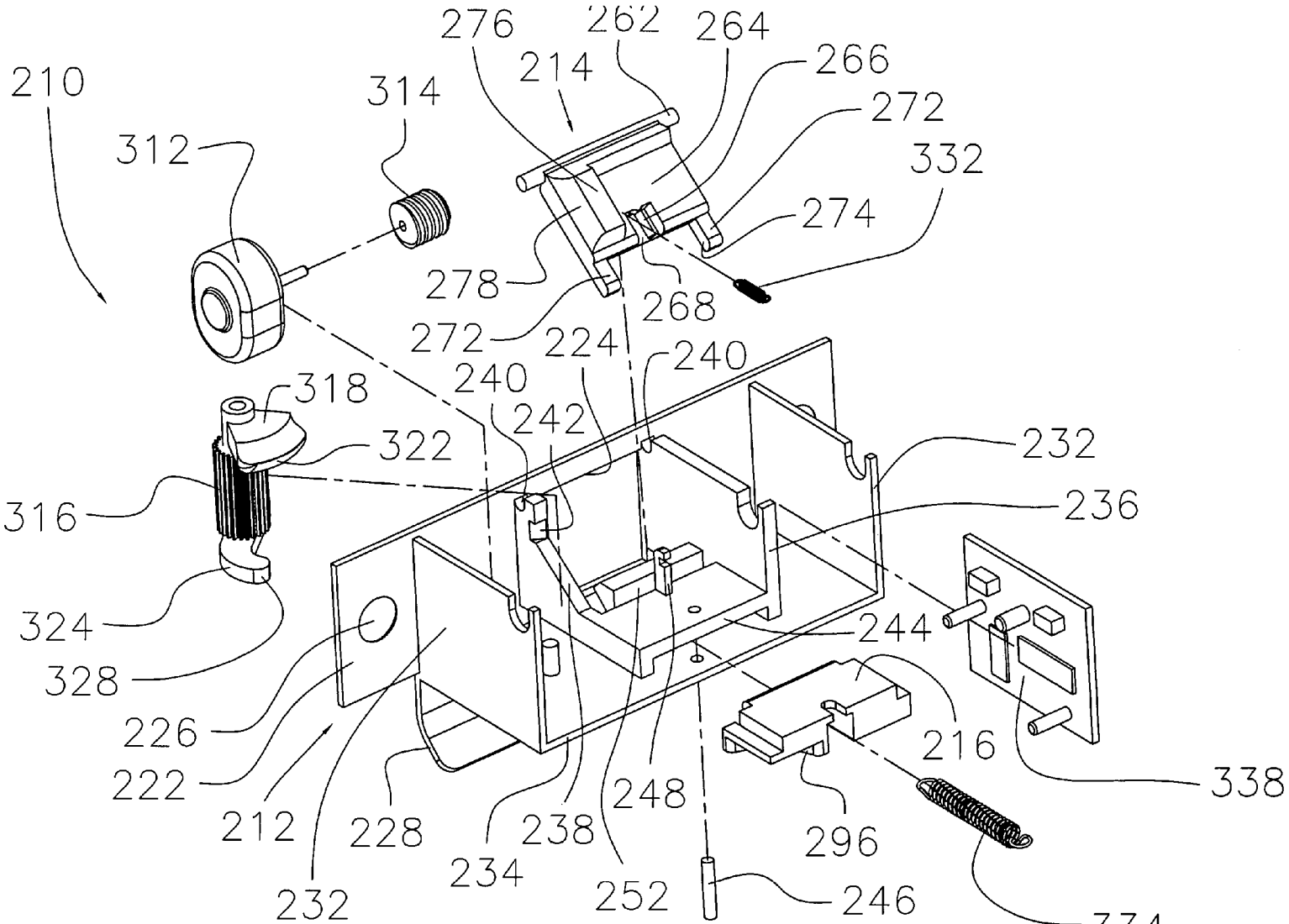
FIG. 8 is an exploded view of a door latch actuator according to a second embodiment.

With reference to FIG. 8 an alternative embodiment of a door latch actuator 210 includes a housing 212, a spring latch bolt actuator 214 and a latch bolt pin actuator 216. The housing 212 includes a strike plate 222, which defines a latch opening 224 and fastener openings 226. A strike lip 228 extends outwardly from the strike plate. The latch opening 224 is dimensioned to receive a spring latch bolt and a corresponding latch bolt pin from an associated deadlatch lock assembly. The fastener openings 226 are adapted to receive conventional fasteners that allow the housing 212 to be mounted to an associated conventional door jam. The strike lip is similarly shaped to a conventional strike lip.

Outermost lateral walls 232 extend from a rear surface of the strike plate 222. A longitudinal wall 234 also extends from the rear surface of the strike plate 222 and connects the outermost lateral walls 232. The longitudinal wall 234 is spaced from the latch opening 224 such that the longitudinal wall does not intersect the latch opening so that the spring latch bolt and latch bolt pin can be received in the latch opening. A first intermediate lateral wall 236 extends from the rear side of the strike plate 222 at the lower side of the latch opening 224. A second intermediate lateral wall 238 extends from the rear side of the strike plate 222 at the upper side of the latch opening 224. The intermediate lateral walls 236 and 238 each include bearing notches 240 disposed on an end of each lateral wall adjacent the rear surface of the strike plate 222. The second intermediate lateral wall 238 includes a receiving notch 242 spaced from the bearing notch 240. The housing 212 is similar to the housing of the first embodiment. The housing 212 of this embodiment can also include additional walls that are not shown to enclose the components of the door latch actuator 210 that will be described below.

A central longitudinal wall 244 connects to the intermediate lateral walls 236 and 238 and is spaced from the longitudinal wall 234. A post 246 connects to the central longitudinal wall 244 and to the longitudinal wall 234 near the back of the housing 212. A hook 248 extends from the central longitudinal wall 244 away from the longitudinal wall 234. A central abutment 252 extends from the central longitudinal wall 244 in the same direction as the hook 248. The central abutment 252 closes off cavity that receives the spring latch bolt, as more clearly seen in FIG. 10.

The spring latch bolt actuator 214 contacts at least the spring latch bolt of the deadlatch lock assembly, similar to the spring latch bolt actuator 14 described with reference FIGS. 1-7. The spring latch bolt actuator 214 includes an integral axle 262 attached to an end of a door 264. The door is generally rectangular in configuration, similar in shape to the latch opening 224. On a rear surface of the door 264, a pin 266 is located in a recess 268. The spring latch bolt actuator 214 also includes two appendages 272 extending from an end of the door 264 opposite the axle 262. The appendages 272 define a central notch 274. The appendages 272 are spaced from one another such that the central abutment 252 can be received in the notch 274 when the spring latch actuator 214 is retracted into the housing 212. The spring latch bolt actuator 214 also includes an L-shaped protuberance 276 which includes a bearing surface 278. The portion of the protuberance near the axle 262 performs a similar function to the abutment 70 on the door 64 of the first embodiment.

Figure 12:
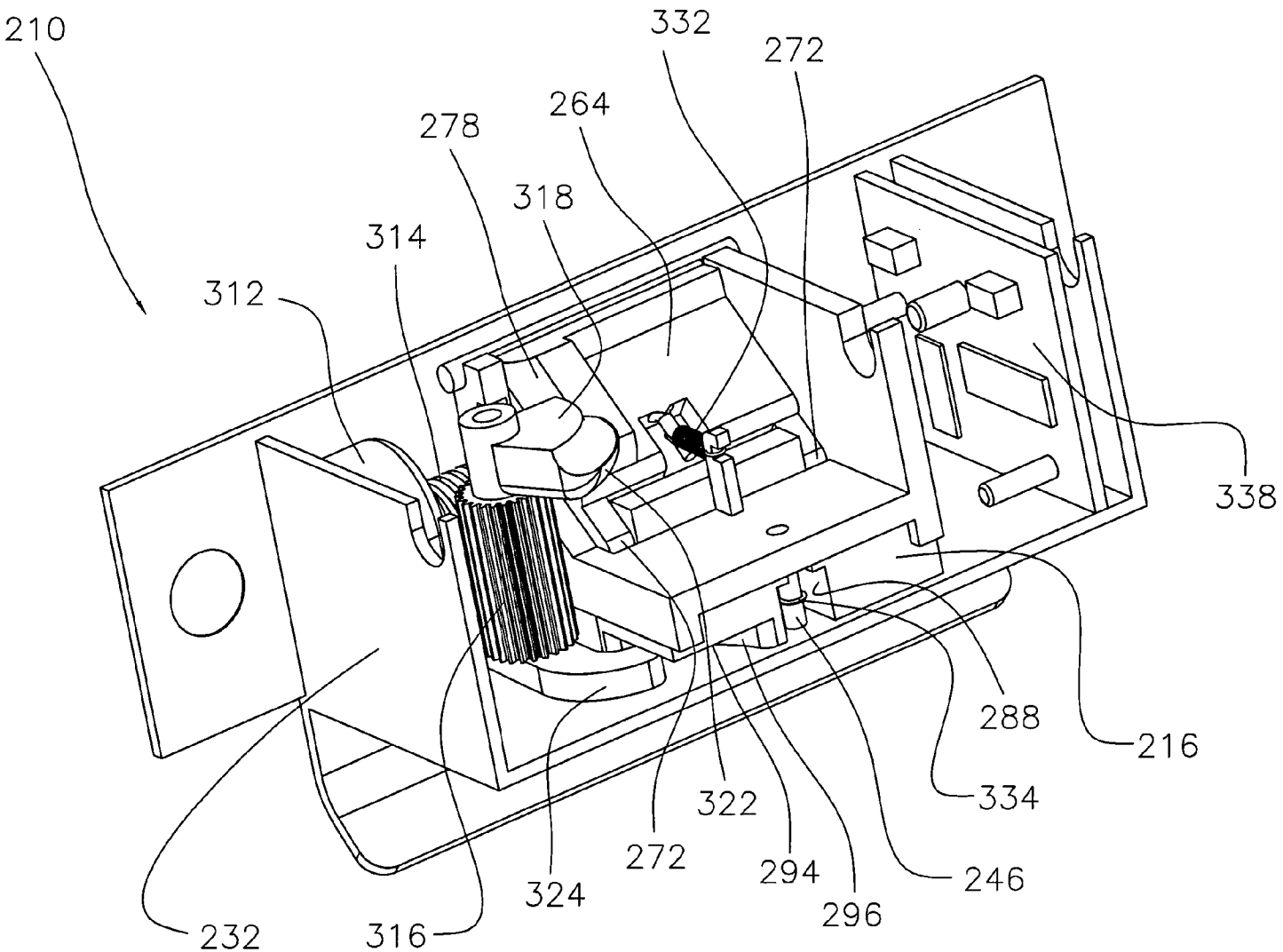
FIG. 12 is a rear perspective view of the assembled door latch actuator of FIG. 8 in a second position.
Figure 13:
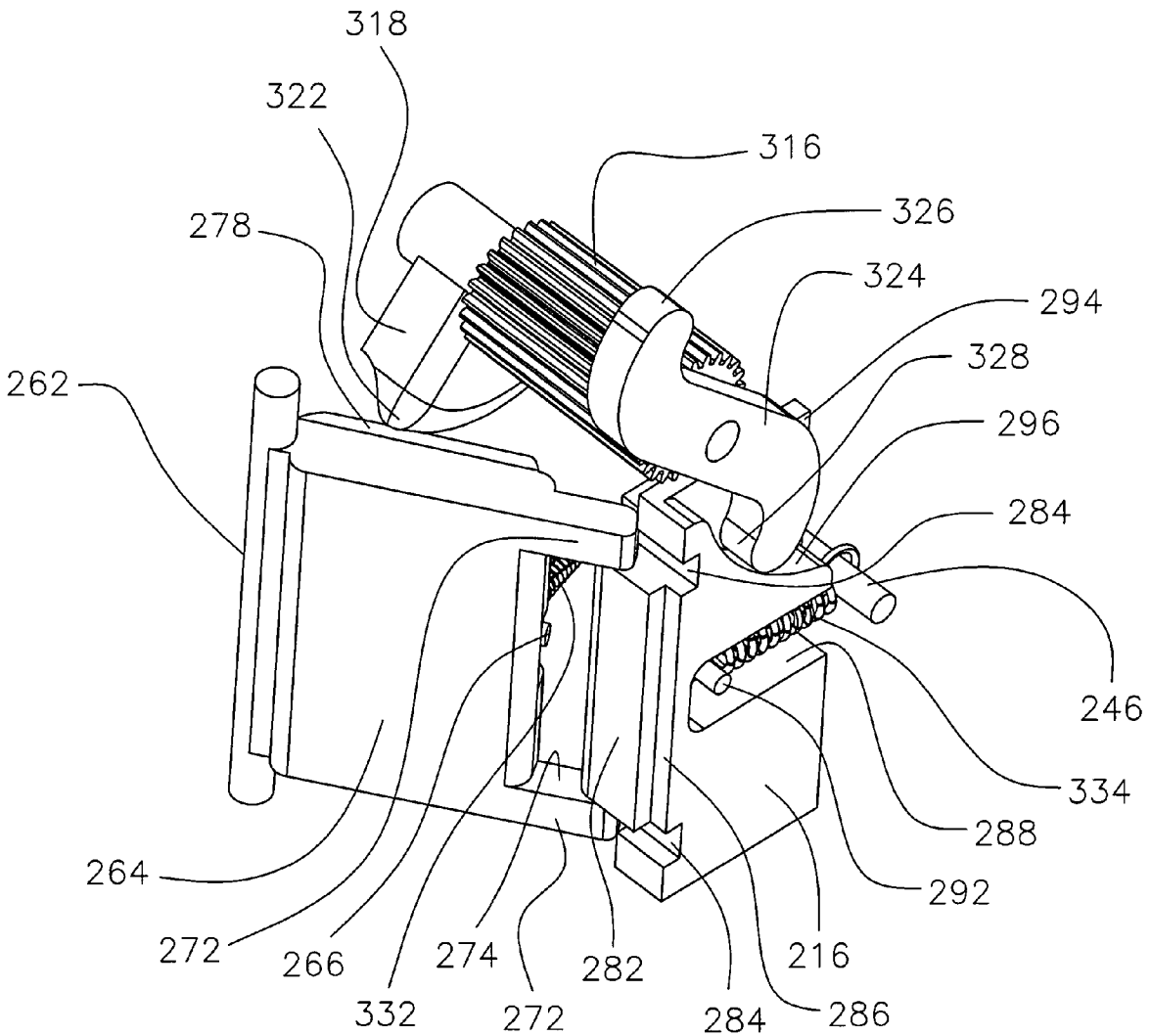
FIG. 13 is a bottom perspective view of the assembled door latch actuator of FIG. 8 in a second position with the housing removed.

The latch bolt pin actuator 216 includes a front contact surface 282 (FIG. 10) shaped similarly to the front surface of blade 78 mentioned above (FIG. 3). The latch bolt pin actuator 216 also includes a pair of front side notches 284 dimensioned to receive the appendages 272 of the spring bolt latch actuator 214. The latch bolt pin actuator 216 also includes a front lower notch 286 (FIG. 11) that receives a portion of the strike plate 222. As more clearly seen in FIG. 12, the latch bolt pin actuator also includes a lower channel 288 having a pin 292 residing therein. On one side of the latch bolt pin actuator, a lower side notch 294 includes an arcuate bearing surface 296 (FIG. 13).

Figure 11:
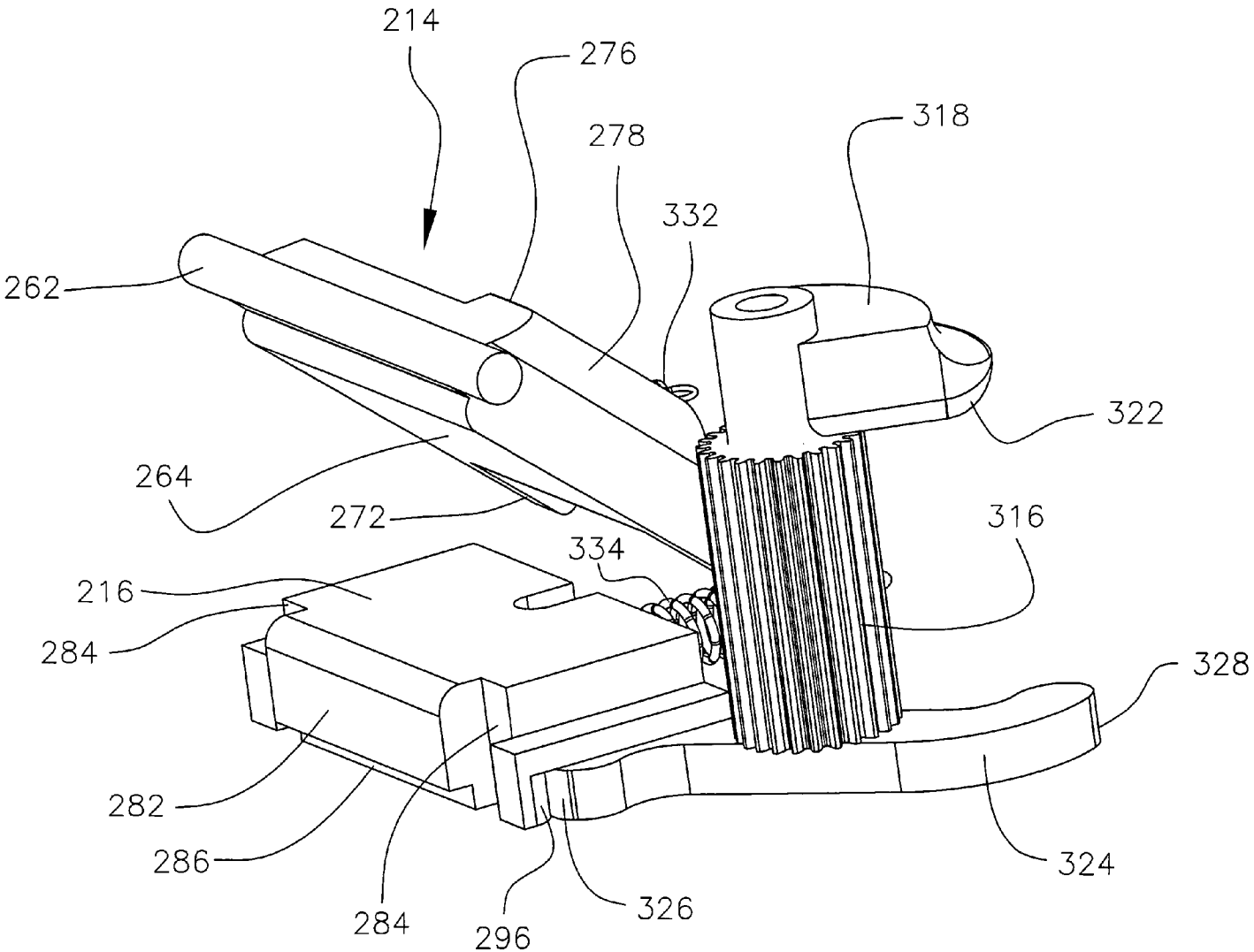
FIG. 11 is a side perspective view of the assembled door latch actuator of FIG. 8 in the first position with the housing removed.

A motor 312 is received in the housing 212 interposed between an outermost lateral wall 232 and the second intermediate lateral wall 238. The motor 312 drives a worm gear 314, which drives a cylindrical gear 316. The cylindrical gear includes a first arm 318 that actuates the spring latch bolt actuator 214. The first arm has a ¼ pie shape and includes an arcuate surface 322 that contacts the bearing surface 278 of the protuberance 276 of the spring latch bolt actuator 214. A second S-shaped arm 324 attaches to an opposite end of the cylindrical gear 316. The second arm 324 includes a first arcuate surface 326 and a second arcuate surface 328 (FIG. 11). As seen in FIG. 13, the S-shaped arm 324 is received in the side notch 294 of the latch bolt pin actuator 216. The arcuate surfaces 326 and 328 ride along the arcuate bearing surface 296 of the latch bolt pin actuator 216.

Figure 9:
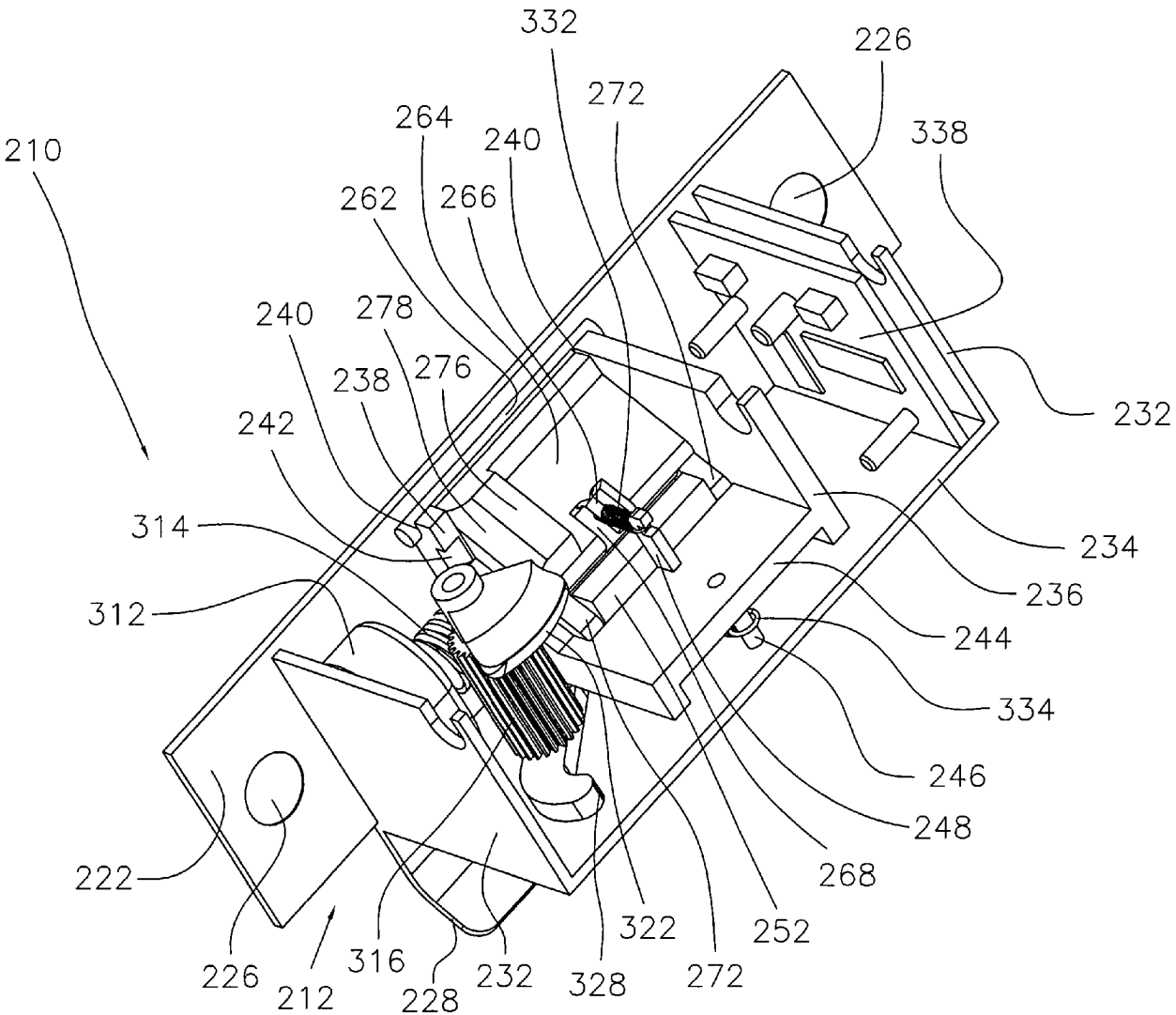
FIG. 9 is a rear perspective view of the assembled door latch actuator of FIG. 8 in a first position.
Figure 14:
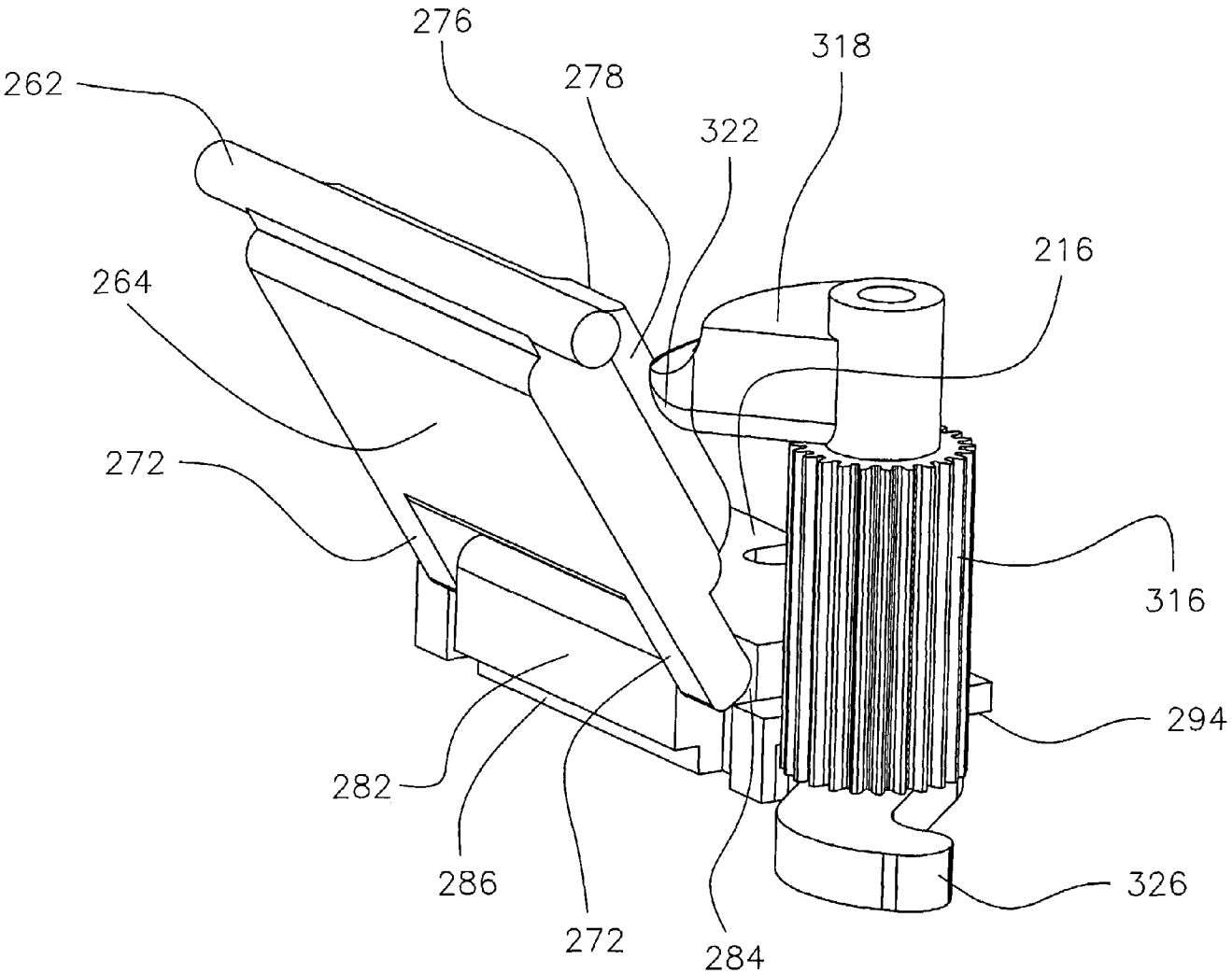
FIG. 14 is a front perspective view of FIG. 13.

When the deadlatch lock assembly is in a "locked" position, a spring 332 that is attached to the post 266 of the spring latch bolt actuator 214 and the hook 248 biases the spring latch bolt actuator away from the latch opening 224, as seen in FIG. 9. With reference to FIG. 11, the first arcuate surface 326 of the S-shaped arm 324 engages the arcuate bearing surface 296 of the latch bolt pin actuator 216 holding the contact surface 282 of the latch bolt pin actuator in the latch opening 224 flush with the front surface of the strike plate. To allow the deadlatch lock assembly to move to the "intermediate" position the cylindrical gear 316 rotates about its axis. As seen in FIGS. 13 and 14, the first arcuate surface 326 moves out of the side notch 294 and no longer contacts the arcuate bearing surface 296 of the latch bolt pin actuator 216. A spring 334, which is connected to the lower pin 292 (FIG. 13) of the latch bolt pin actuator and the post 246 of the housing biases the latch bolt pin actuator 216 out of the latch opening 224. This allows the latch bolt pin to extend so that the deadlatch lock assembly is now in the "intermediate" position.

Figure 15:
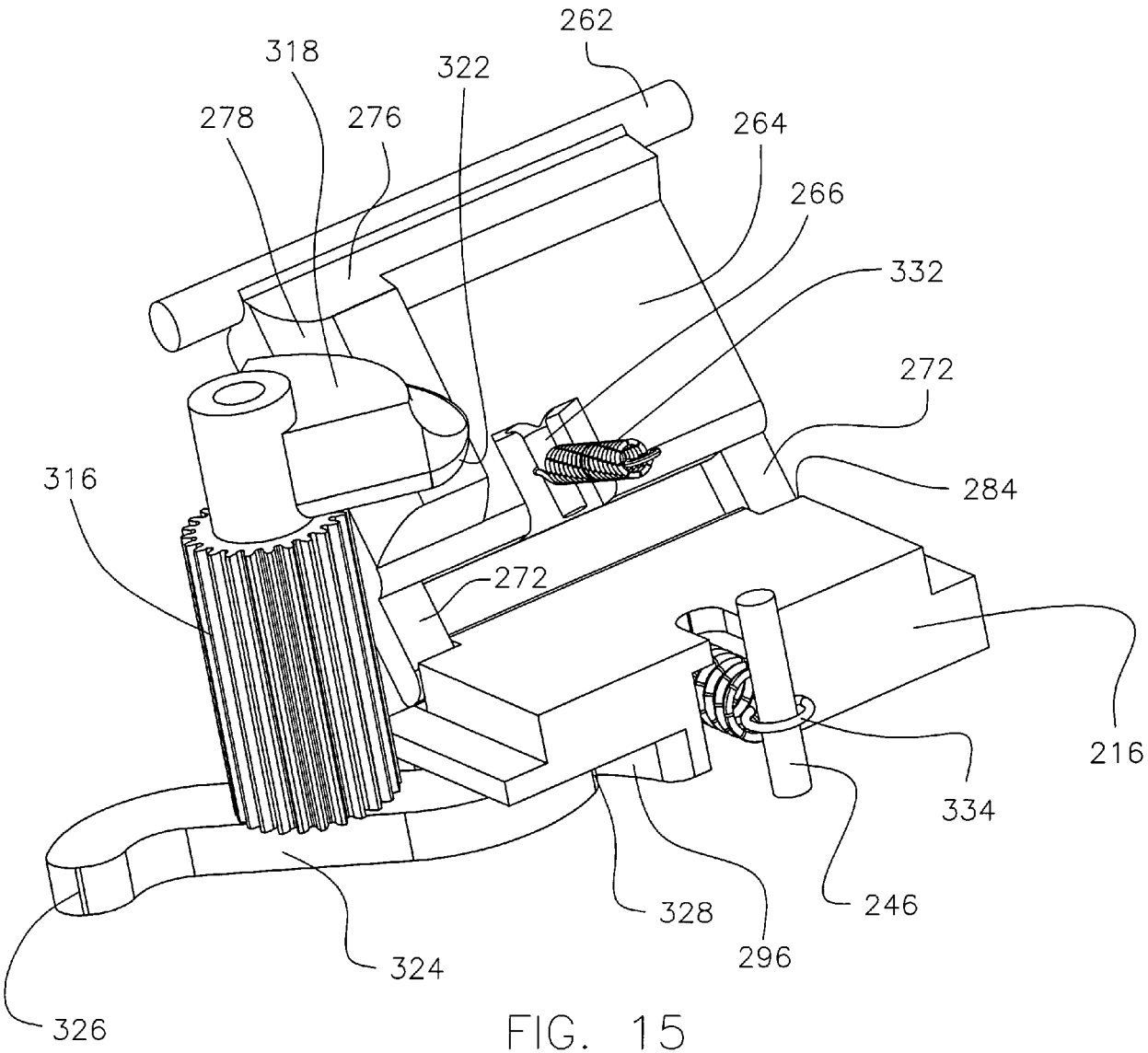
FIG. 15 is a rear perspective view of FIG. 13.
Figure 16:
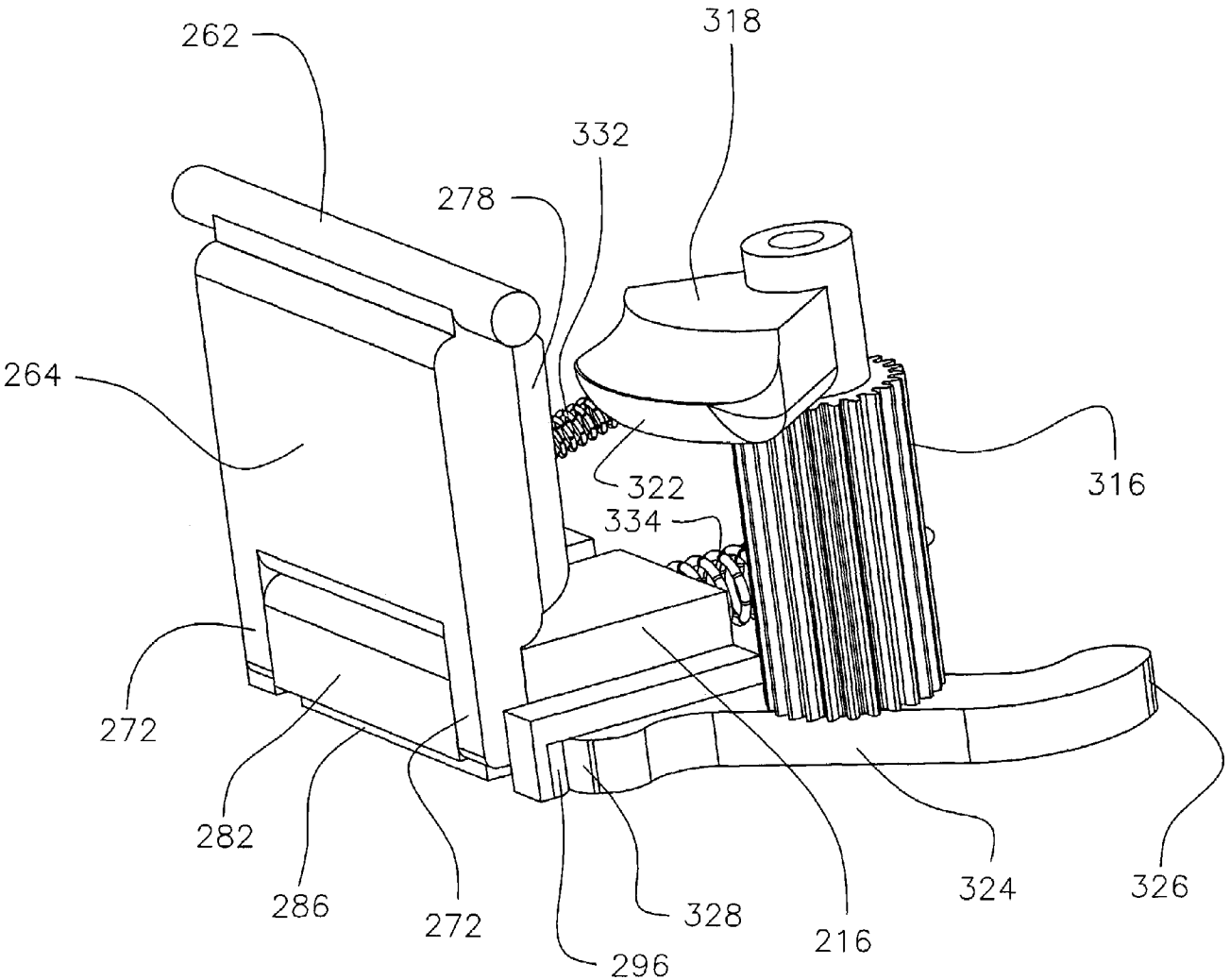
FIG. 16 is a front side perspective view of the assembled door latch actuator of FIG. 8 in a third position with the housing removed.
Figure 18:
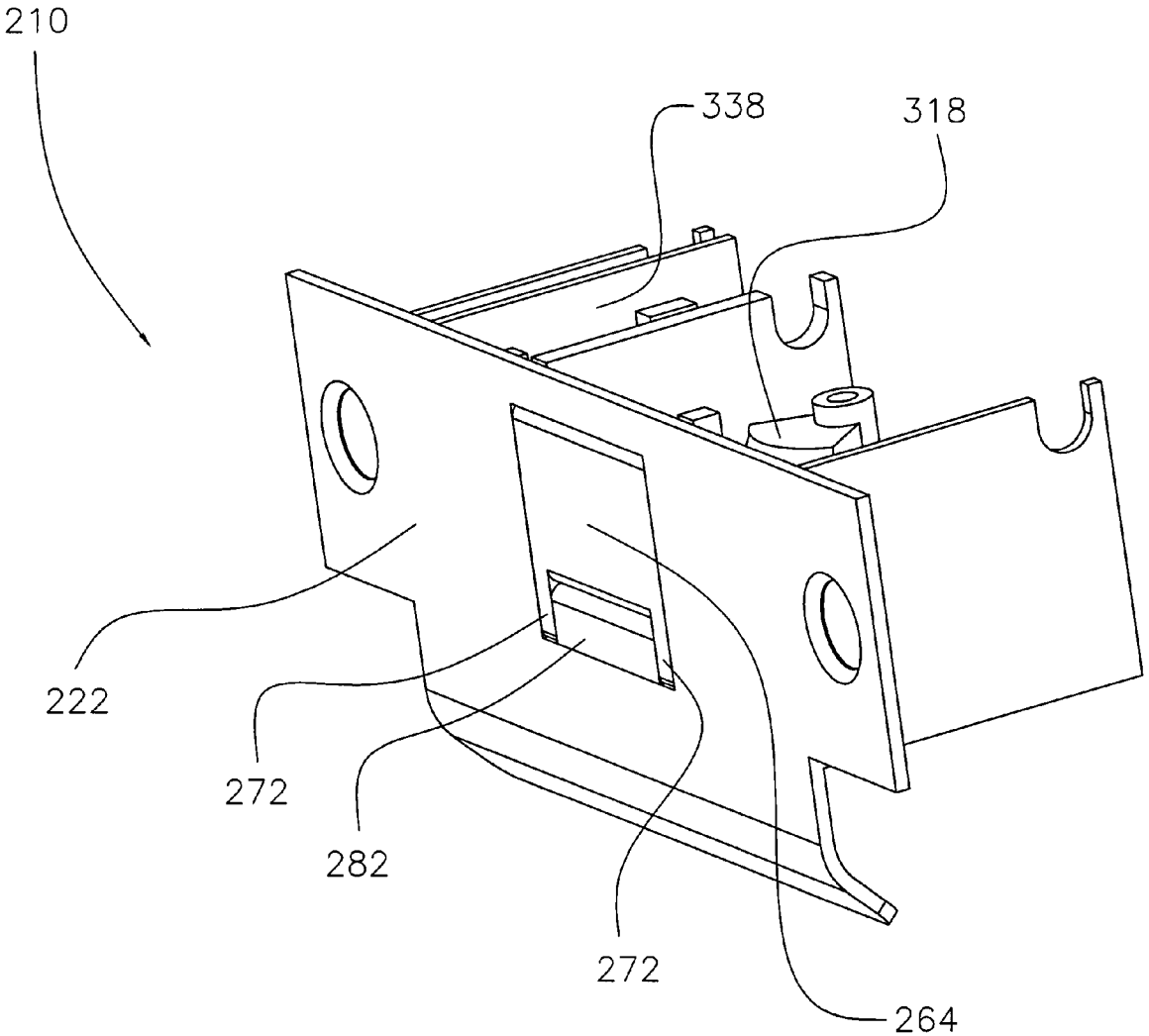
FIG. 18 is a front perspective view of FIG. 17.

With reference to FIG. 15, as the cylindrical gear 316 continues to rotate the first arm 318 contacts the bearing surface 278 of the protuberance 276 pivoting the spring latch bolt actuator 214 towards the latch opening 224. As the cylindrical gear 316 continues to rotate the appendages 272 of the spring latch bolt actuator 214 also continue to move towards the latch opening 224. As the cylindrical gear continues to rotate, the second arcuate surface 328 of the S-shaped arm 324 contacts the bearing surface 296 of the latch bolt pin actuator 216 moving the latch bolt pin actuator towards the latch opening 224. As the latch bolt pin actuator 216 continues to move forward the side notches 284 receive the appendages 272 of the spring latch bolt actuator 214. With reference to FIG. 16, the S-shaped arm 324 continues to drive the latch bolt pin actuator 216 forward. This action allows the door latch actuator 210 to move the spring latch bolt and the dead latch pin to a retracted position, which positions the deadlatch lock assembly in an "unlock" position. As seen in FIG. 18, the latch opening 224 is entirely covered by both the spring latch bolt actuator 214 and the latch bolt pin actuator 216.

Figure 10:
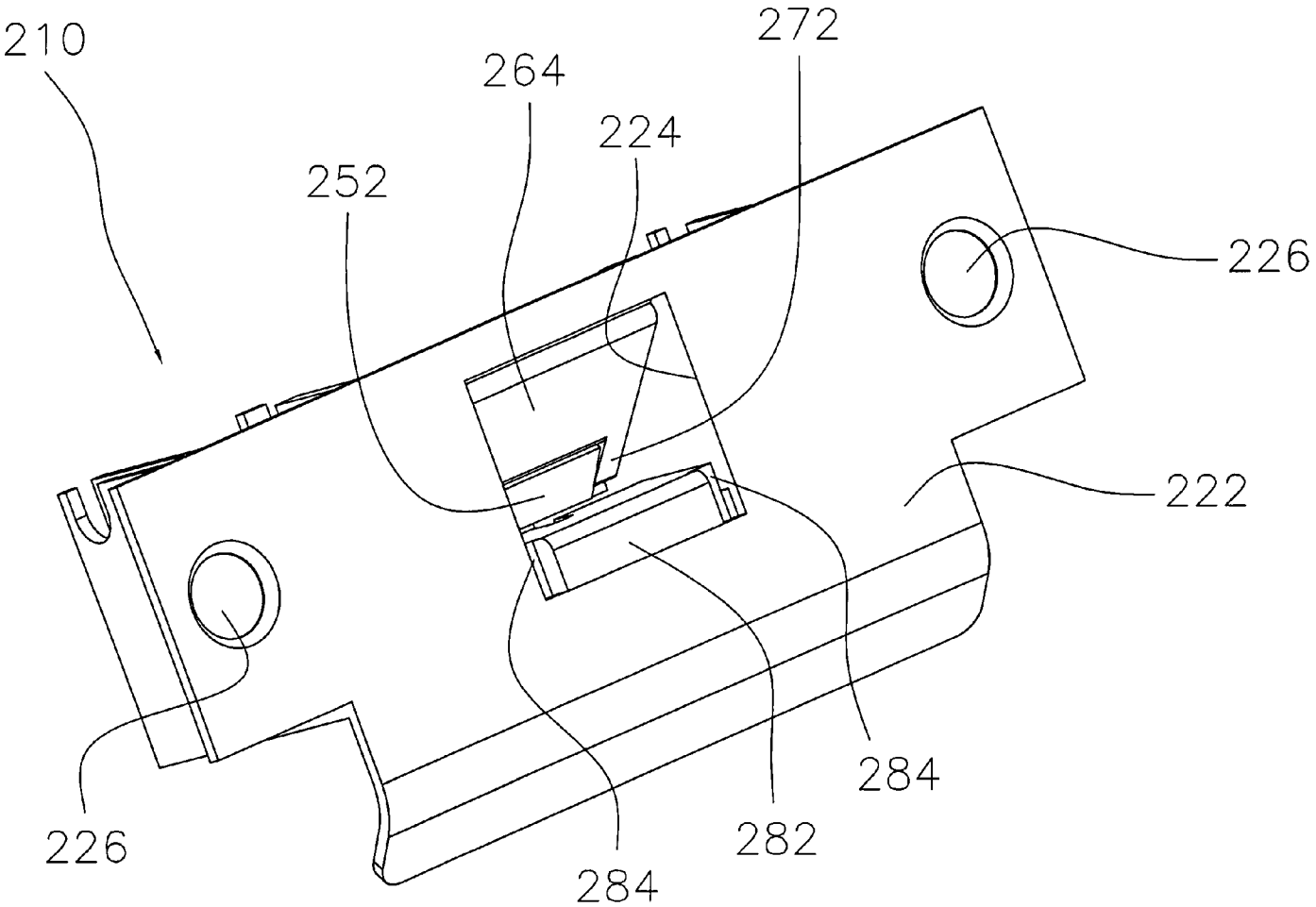
FIG. 10 is a front perspective view of FIG. 9.
Figure 17:
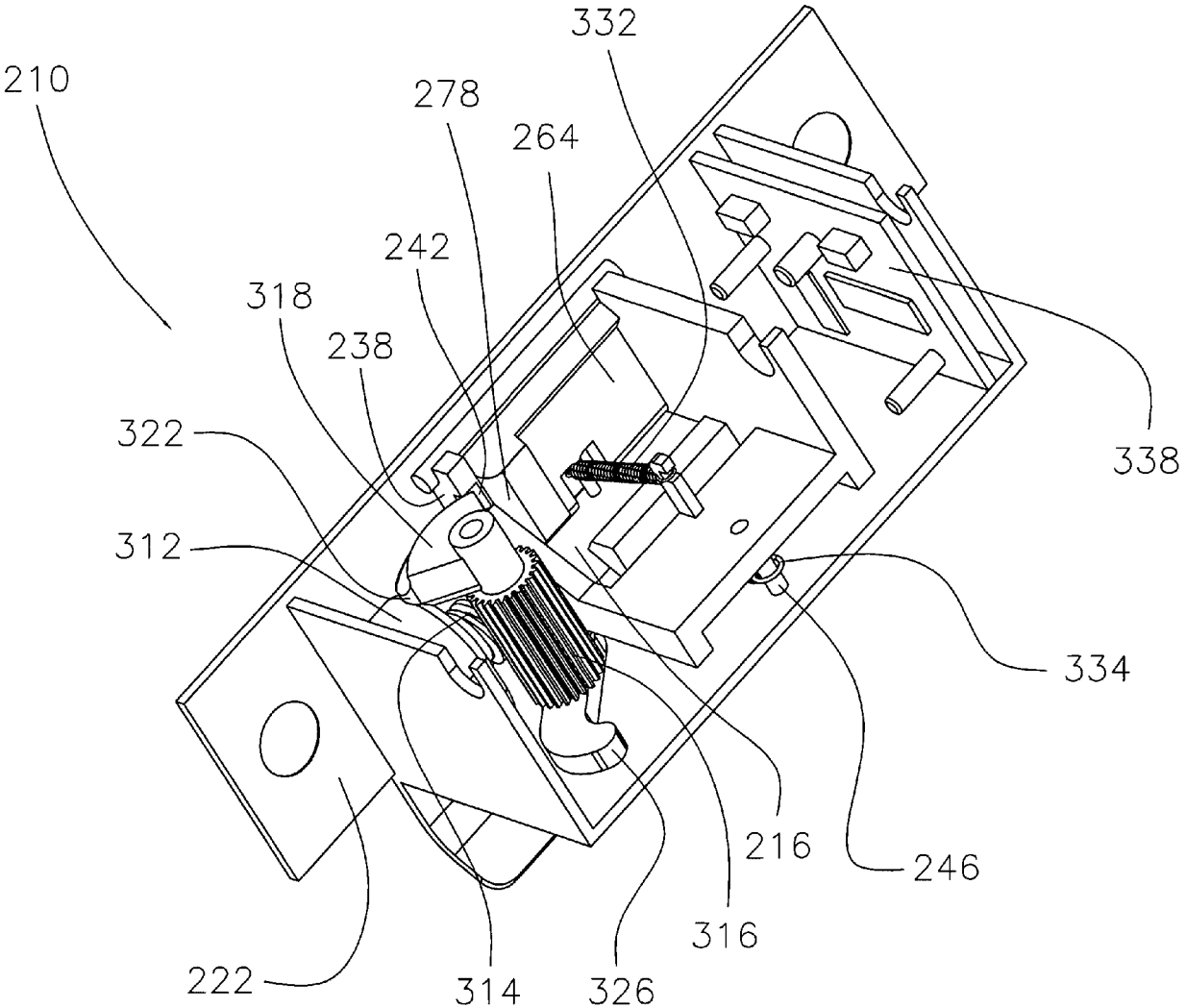
FIG. 17 is a rear perspective view of the assembled door latch actuator of FIG. 8 in the third position.

Since the latch bolt pin actuator 216 receives the appendages 272 of the spring latch bolt actuator 214, the first arm 318 no longer has to drive the door 264 forward, as seen in FIG. 16. The notch 242 (FIG. 17) in the second intermediate lateral wall 238 can allow the first arm 318 to rotate freely away from the door 264. As the cylindrical gear 316 continues to rotate, the second arcuate surface 328 will move out of the notch 294 and the springs 332 and 334 will bias the spring latch bolt actuator 214 and the latch bolt pin actuator 216, respectively, out of the latch opening 224. The motor can continue to rotate in the same direction to move the door latch actuator 210 back to where it can receive the deadlatch lock assembly in a "locked" position (FIGS. 9, 10 and 11).

A circuit board 338 can be provided to control the motor, similar to the circuit board 122 described above with reference to FIGS. 1-7. The embodiment depicted in FIGS. 8-18 need not use a reversible motor or clutch assembly to change the direction of rotation of the motor. The cylindrical gear 316 and its arms 318 and 324 cooperate with the actuators 214 and 216 such that the cycle of movement required to open a door's deadlatch lock assembly having a spring latch and latch bolt pin can be repeated without having the motor change its direction of rotation. Limit switches or other switching/sensing means can be provided on or remotely connected to the circuit board to control the rotation of the motor if it is desired.

In another alternative embodiment, a door latch actuator 410 includes a housing 412, a spring latch bolt actuator 414 and a latch bolt pin actuator 416. The housing 412 of the door latch actuator includes a strike plate 422, which defines a latch opening 424 and fastener openings 426. A strike lip 428 extends outwardly from the strike plate. The latch opening 424 receives a spring latch bolt and a corresponding latch bolt pin from an associated deadlatch lock assembly. The fastener openings 426 receive conventional fasteners that allow the housing 412 to be mounted to an associated door jamb. The strike lip is similarly shaped to a conventional strike lip.

Outermost lateral walls 432 extend from a rear surface of the strike plate 422. A longitudinal wall 434 extends from the rear surface of the strike plate and connects the outermost lateral walls. Intermediate lateral walls 436 extend from the rear side of the strike plate 422 at the upper and lower sides of the latch opening 424. The intermediate lateral walls 436 include bearing notches 438 disposed on an end of each of the intermediate lateral walls adjacent the rear surface of the strike plate. Mounting supports 444 extend from the longitudinal wall 434 and align with the intermediate lateral walls 436. The mounting supports 444 include bearing surfaces 446. A rear wall 448 extends from the longitudinal wall 434 spaced from the latch opening 424. A riding notch 452 is defined in the housing underneath each intermediate side wall 436 and cut out of a portion of the rear wall 448. A projection 456 also extends from the rear side of the strike plate 422. The projection includes an opening 458 extending through the projection. The housing 412 is similar to the housing 12 described above with reference to the first embodiment and can include additional walls (not shown) to enclose the components that are described below.

The spring latch bolt actuator 414 is similarly shaped to the spring latch bolt actuator 14 described with reference to the first embodiment and includes an integral axle 460 attached near an abutment 462 which attaches to a rear side of a door 464. An L-shaped appendage 466 depends from the axle 460. The L-shaped appendage 466 includes an opening 468 extending through the appendage. A torsion spring 470 is received in the opening 458 of the projection 456 of the housing 412 and the opening 468 of the L-shaped appendage 466 to bias the spring latch bolt actuator 414 away from the latch opening 424. When the door 464 is pivoted back into the housing 412, the abutment 462 contacts a longitudinal wall (not shown) that is opposite the longitudinal wall 434, stopping the door from pivoting further. The door 464 of the spring latch bolt actuator 414 has a front surface that is similarly shaped to the latch opening 424, so that when the spring latch bolt actuator 414 moves into the latch opening 424, the front surface of the door 464 can cover the opening, as will be described in more detail below. The axle 460 is received in the bearing notches 438 of the intermediate lateral walls 436 so that the spring latch bolt actuator 414 can rotate about the axle 460.

Figure 19:
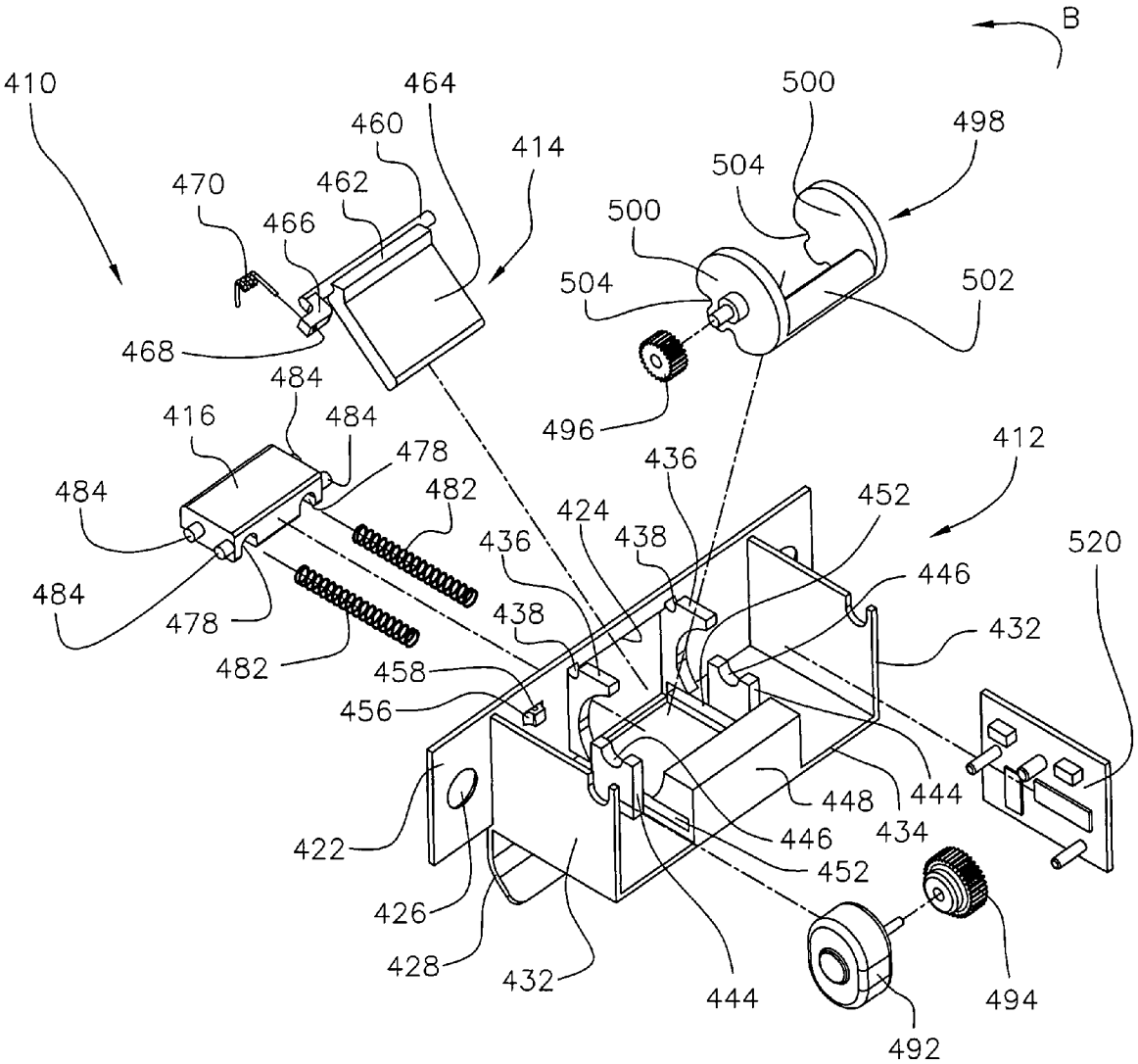
FIG. 19 is an exploded view of a door latch actuator according to a third embodiment.
Figure 20:
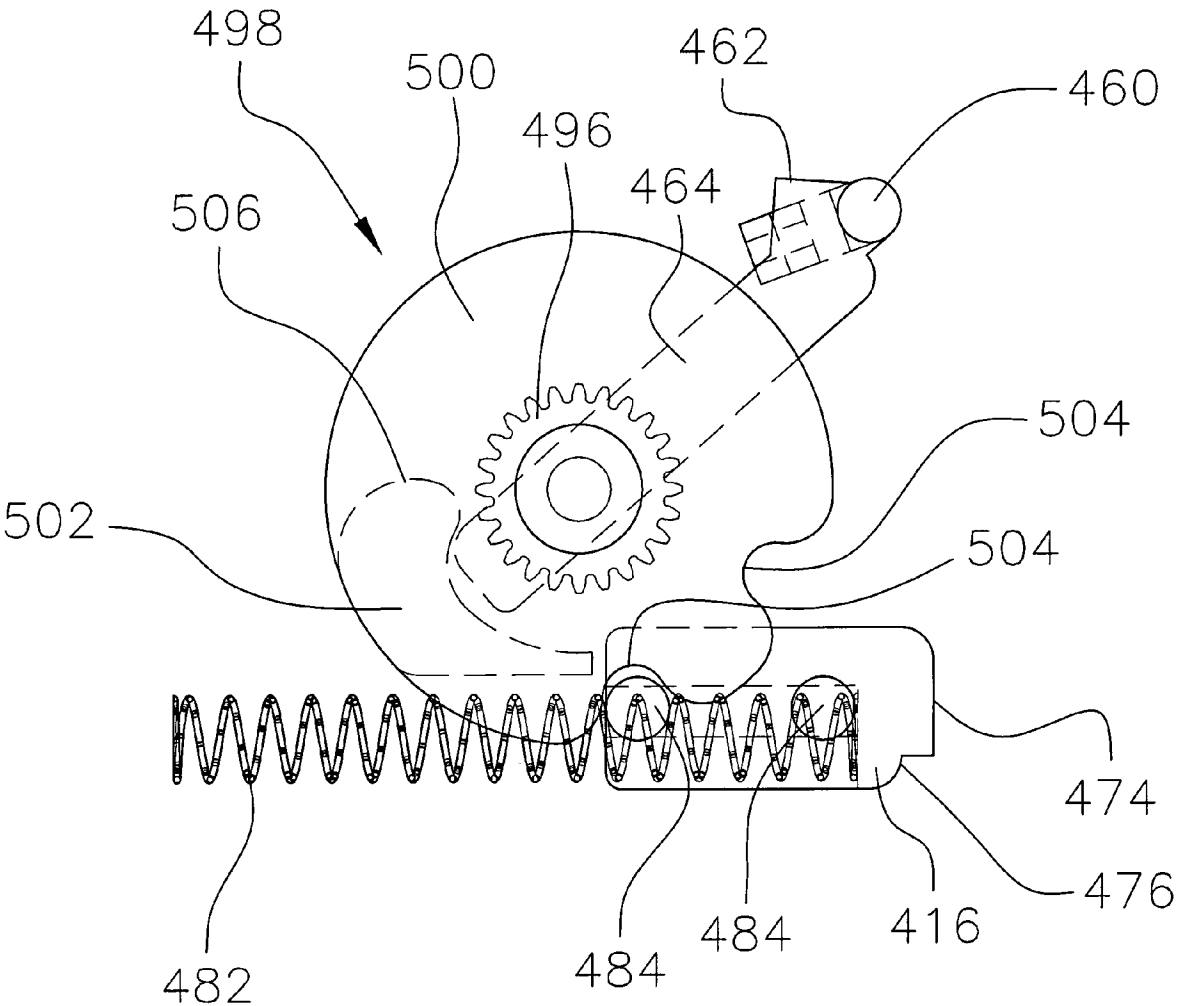
FIG. 20 is a side view of the assembled internal components of the door latch actuator of FIG. 19 in a first position with the housing removed and with some internal features being represented by dashed lines.
Figure 21:
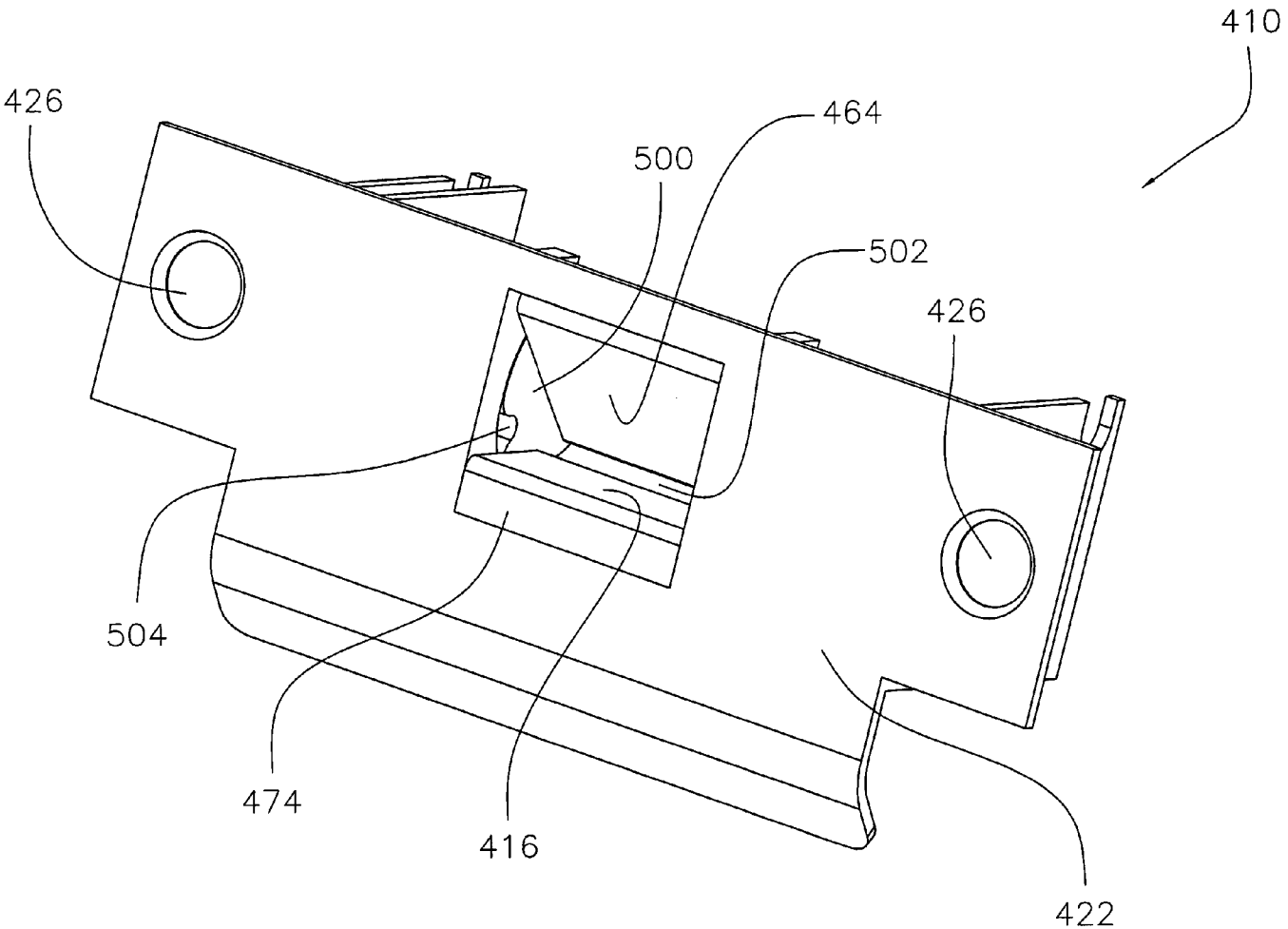
FIG. 21 is a front perspective of the assembled door latch actuator of FIG. 19 in a first position.

With reference to FIG. 20, the latch bolt pin actuator 416 includes a front surface 474 having a lower front notch 476. The front surface 474 has a length equal to that of the latch opening 424. The lower front notch 476 receives the strike plate 422 when the latch bolt pin actuator 416 is extended such that the front surface 474 is flush with the front surface of the strike plate 422 in the latch opening 424, as seen in FIG. 21. With reference back to FIG. 19, the latch bolt pin actuator 416 also includes lower rear channels 478 that receive biasing members 482, which in this embodiment are springs. The springs 482 contact the rear wall 448 and bias the latch bolt pin actuator 416 toward the latch opening 424. The latch bolt pin actuator 416 also includes four posts 484, two on each side of the latch bolt pin actuator.

Figure 26:
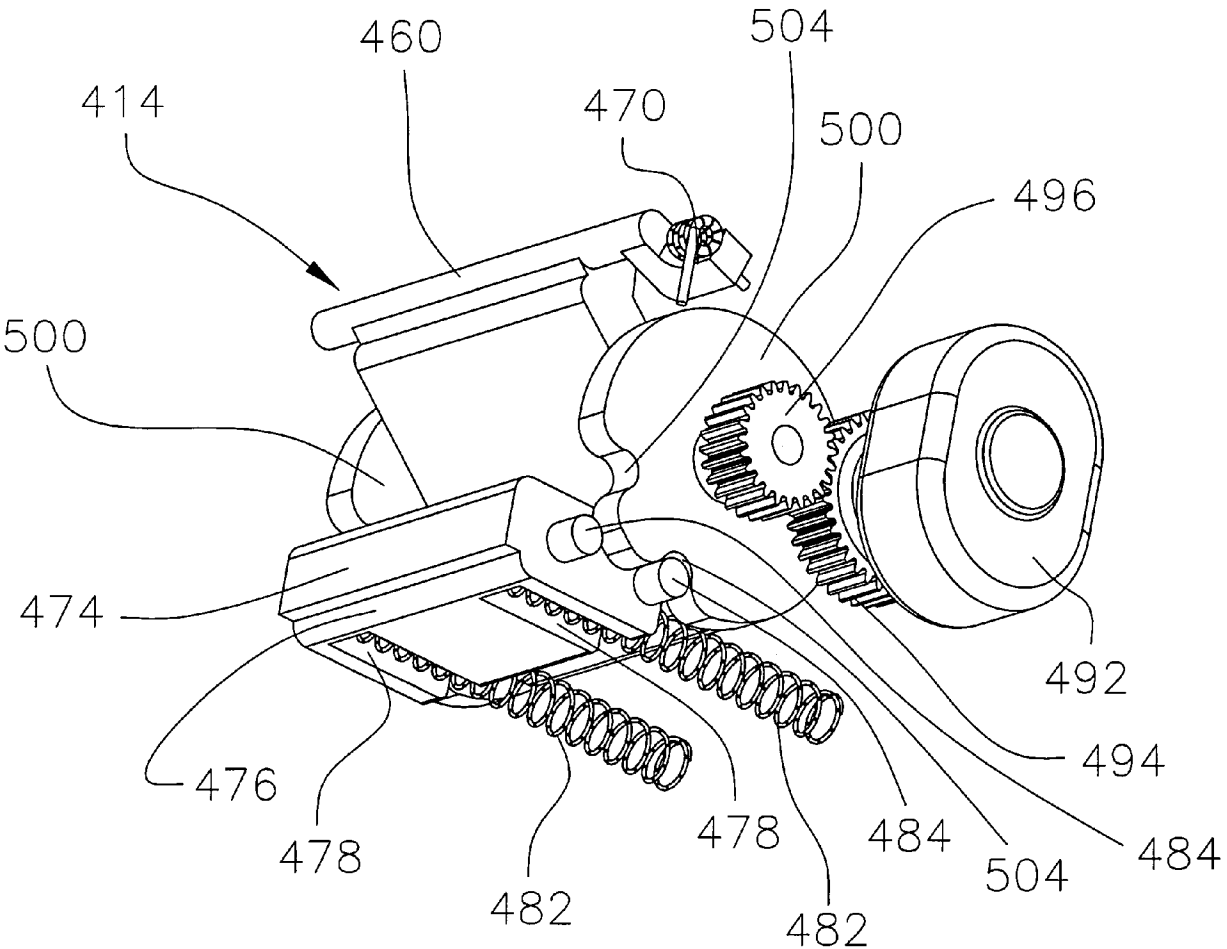
FIG. 26 is a front perspective view of the assembled door latch actuator of FIG. 19 in the first position with the housing removed.

A motor 492 is provided to move the spring latch bolt actuator 414 and the latch bolt pin actuator 416 between first and second positions. The motor 492 drives a gear 494, which drives a pinion 496. The pinion 496 attaches to an actuating element 498 that moves the spring latch bolt actuator 414 and the latch bolt pin actuator 416. The actuating element 498 includes a pair of cams 500 spaced from one another and connected by a brace 502. Each of the cams includes a pair of receiving notches 504 that are adapted to receive the posts 484 of the latch bolt pin actuator 416 (FIGS. 20 and 26).

With the door latch actuator 410 in a "locked" position as seen in FIG. 20, the front surface 474 of the latch bolt pin actuator 416 is extended in the latch opening 424 flush with the front surface of the strike face 422, as seen in FIG. 21. The motor 492 rotates the actuating element 498 as shown by arrow B (FIG. 19) and the receiving notches 504 of the actuating element 498 receives the posts 484 of the latch bolt pin actuator 416 (as more clearly seen in FIG. 20) and drives the latch bolt pin actuator away from the latch opening 424.

Figure 22:
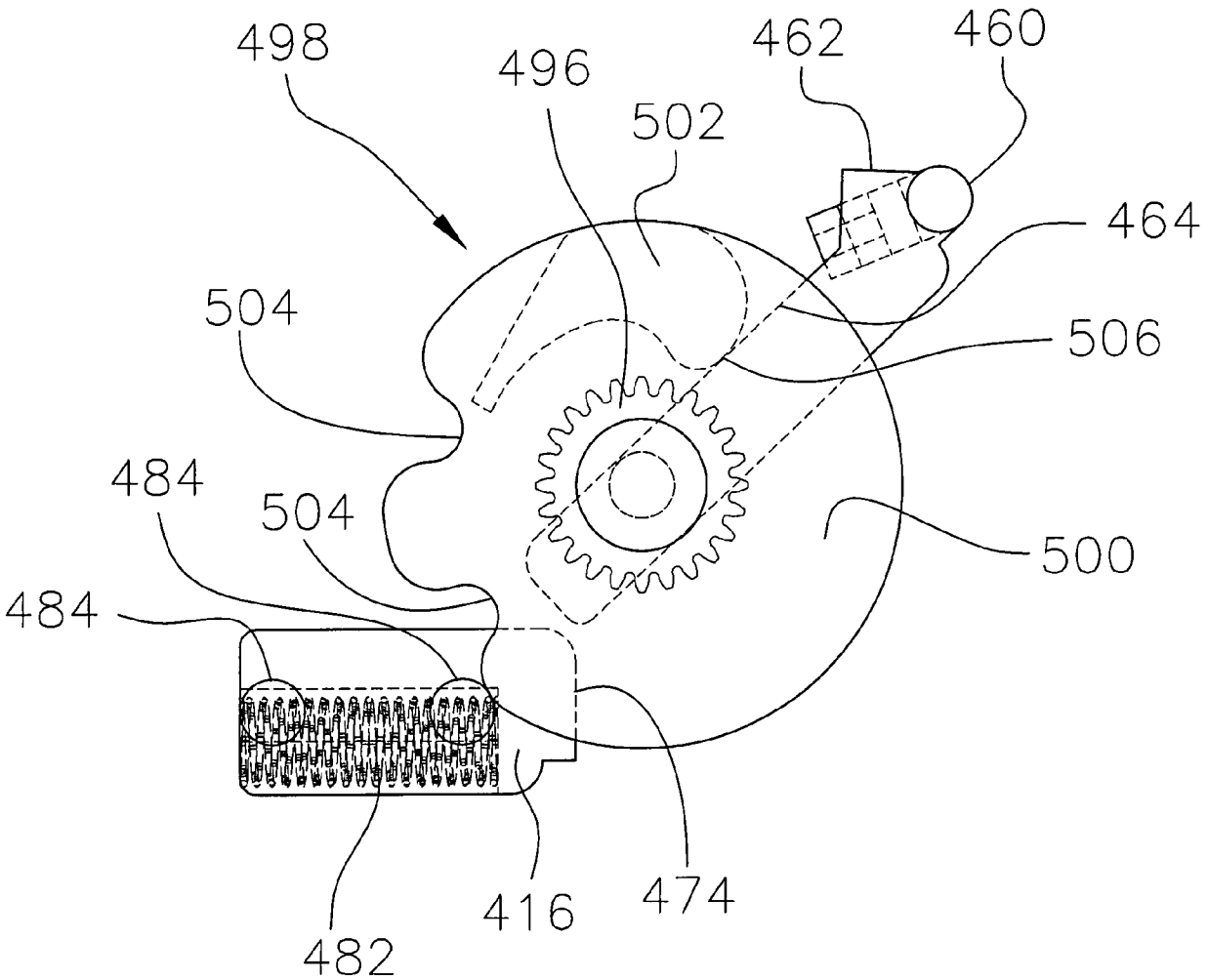
FIG. 22 is a side view of the assembled internal components of the door latch actuator of FIG. 19 in a second position with the housing removed and with some internal features being represented by dashed lines.
Figure 24:
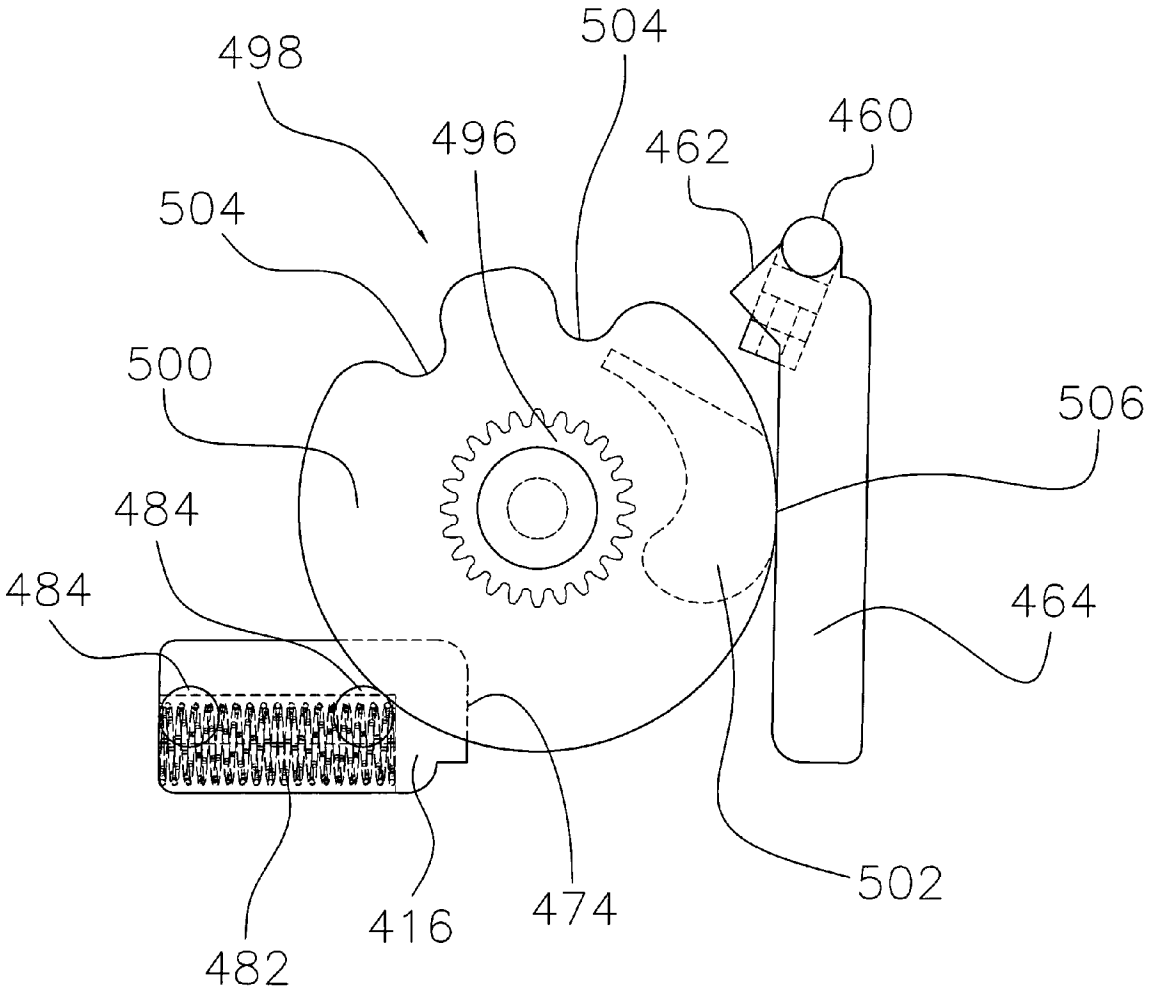
FIG. 24 is a side view of the assembled internal components of the door latch actuator of FIG. 19 in a third position with the housing removed and with some internal features being represented by dashed lines.
Figure 25:
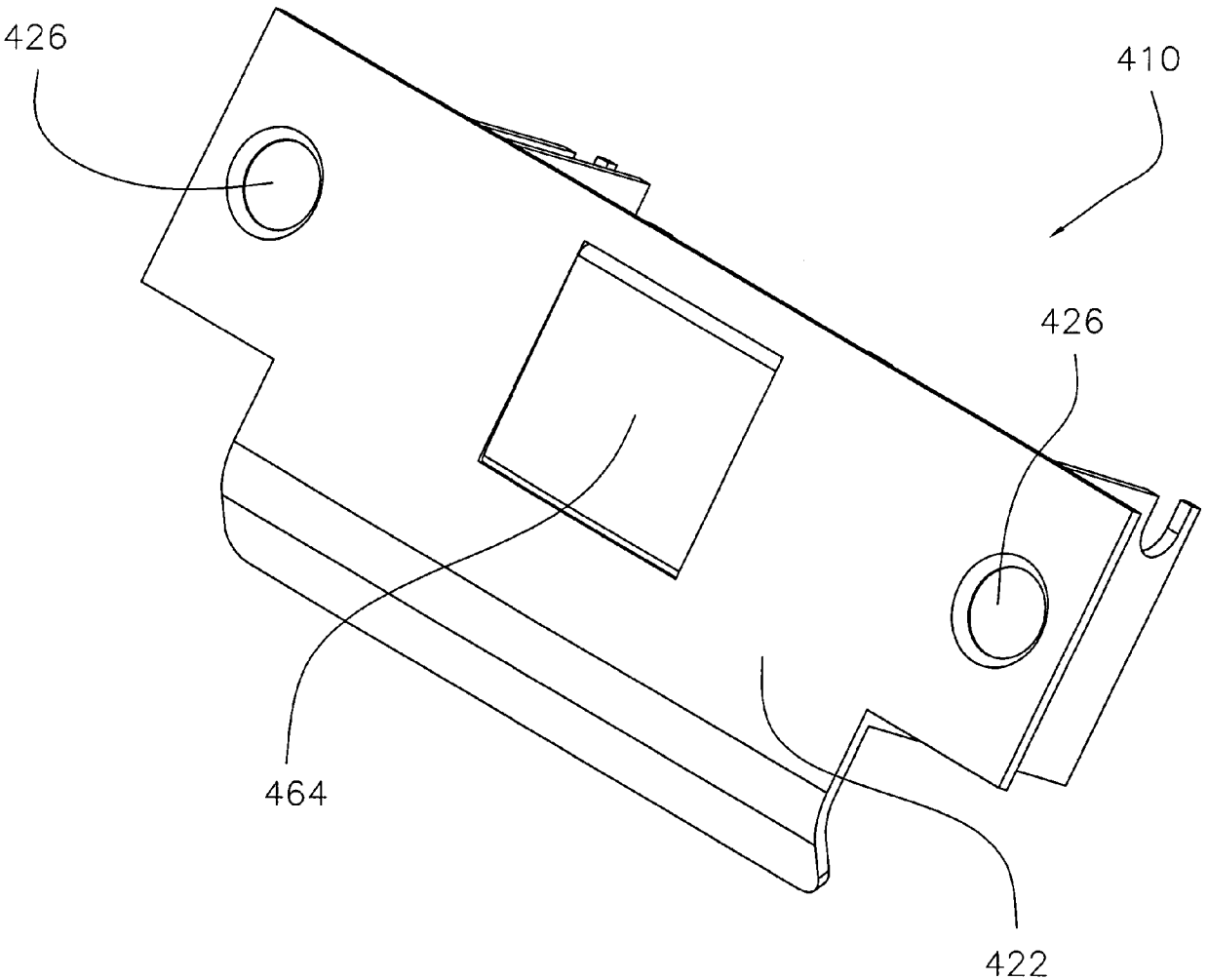
FIG. 25 is a front perspective of the assembled door latch actuator of FIG. 19 in the third position.

With reference to FIG. 22, the actuating element 498 continues to rotate the cam 500 moving the latch bolt pin actuator 416 away from the latch opening 424 in a linear directional movement. The movement of the latch bolt pin actuator 416 into the housing allows the latch bolt pin of the deadlatch lock assembly to extend so that the deadlatch lock assembly is in an "intermediate" position. Further rotation of the actuating element 498 also moves the brace 502 towards a rear surface of the door 464 of the spring latch bolt actuator 414. As can be seen in FIG. 22, the brace 502 includes an arcuate surface 506 that first contacts the rear surface of the door 464. With reference back to FIG. 20, the brace 502 is appropriately shaped so that it does not contact the door 464 until the arcuate surface 506 contacts the upper portion of the door (FIG. 22). With reference to FIG. 24, the actuating element 498 continues to rotate and the arcuate surface 506 of the brace 502 is shaped such that the brace 502 can move the door 464 of the spring latch bolt actuator 414 into the latch opening 424 such that the front surface of the door 464 is flush with the strike plate 422 (see FIG. 25). While the actuating element 498 rotates, the posts 484 disposed closest to the front surface 474 of the latch bolt pin actuator 416 are retained by a peripheral side on each cam 500, as seen in FIG. 24.

To move the components of the door latch actuator 410 back so that the deadlatch lock assembly can return to a "locked" position, the motor 492 rotates the actuating element 498 in an opposite direction. The brace 502 moves away from the rear side of the door 464 and the spring 470 biases the door back into the housing 412 when the brace 502 is no longer in contact with the door. The springs 482 bias the latch bolt pin actuator 416 towards the latch opening 424. The posts 484 engage the notches 504 on the cams 500 to continue to drive the latch bolt pin actuator towards the latch opening (FIGS. 20 and 26).

Figure 23:
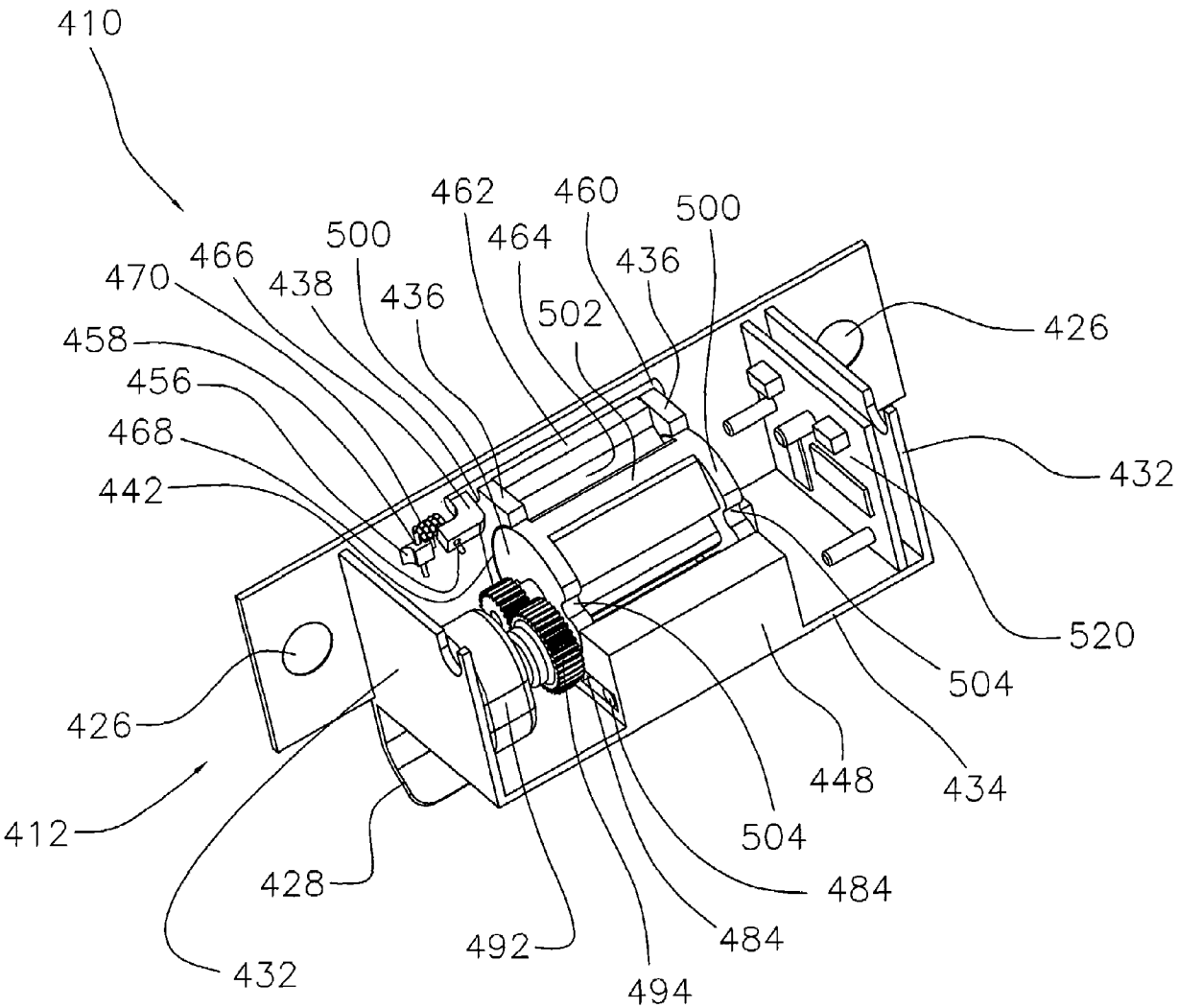
FIG. 23 is a rear perspective of the assembled door latch actuator of FIG. 19 in a second position.

In an alternative embodiment, the actuating element can continue rotating in the same direction and the door latch actuator 410 can reset itself. In this embodiment, as the actuating element 498 continues rotating clockwise as shown in FIG. 23, the brace 502 will eventually no longer contact the back side of the door 464 of the spring latch actuator. In this embodiment, the cams would be appropriately dimensioned to allow the springs 482 to return the latch pin actuator 416 toward the latch opening 424 without contacting the cams.

Figure 27:
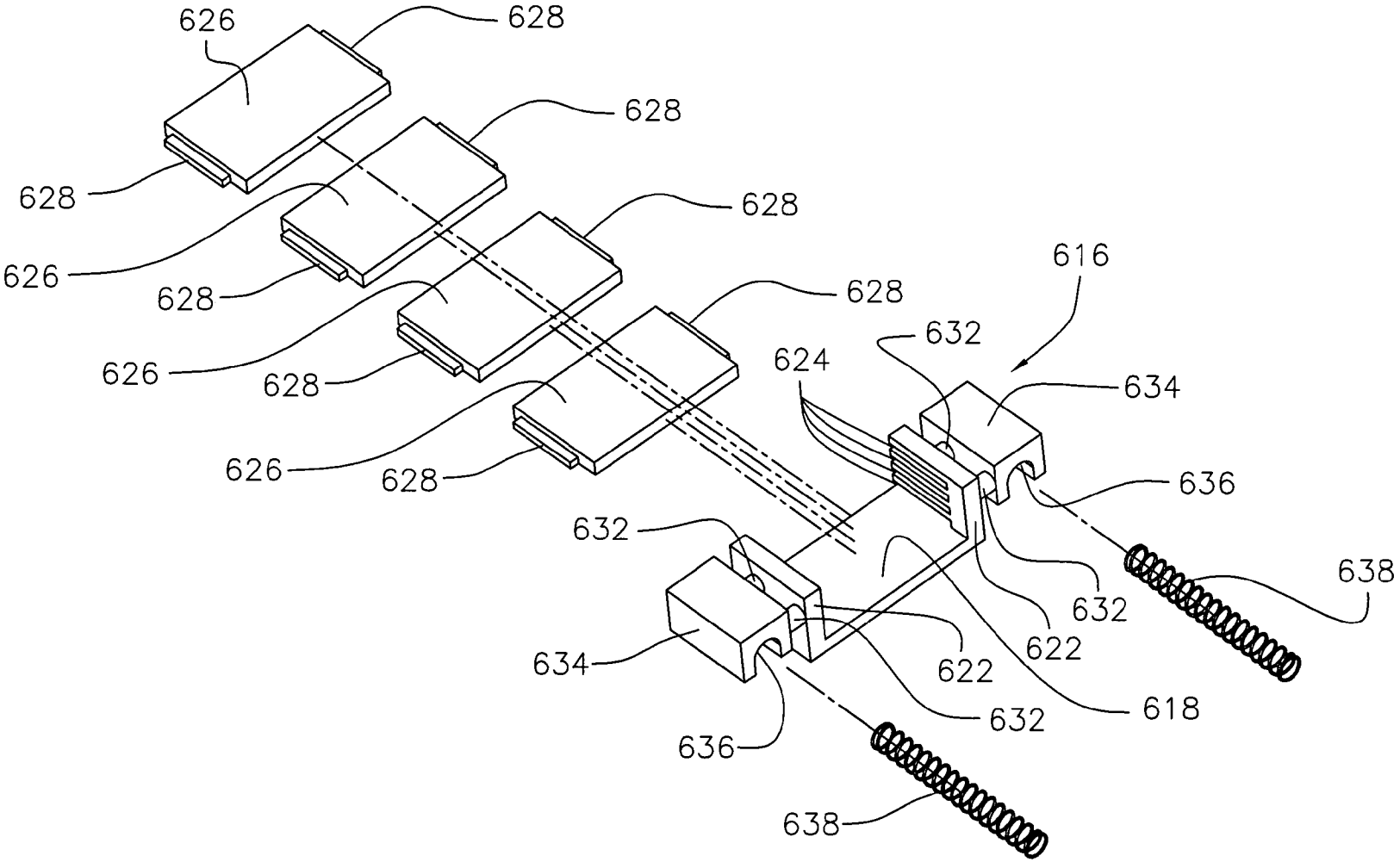
FIG. 27 is an exploded view of an alternative latch bolt pin actuator.

An alternative latch pin actuator 616 is shown in FIG. 27. The latch pin actuator includes a base wall 618 having a pair of spaced lateral walls 622 extending from the base wall. Each lateral wall includes a plurality of notches 624 that are offset from the rear of the lateral walls. The notches 624 allow the lateral walls 622 to receive plates 626 that can change the height of the latch pin actuator 616.

Figure 28:
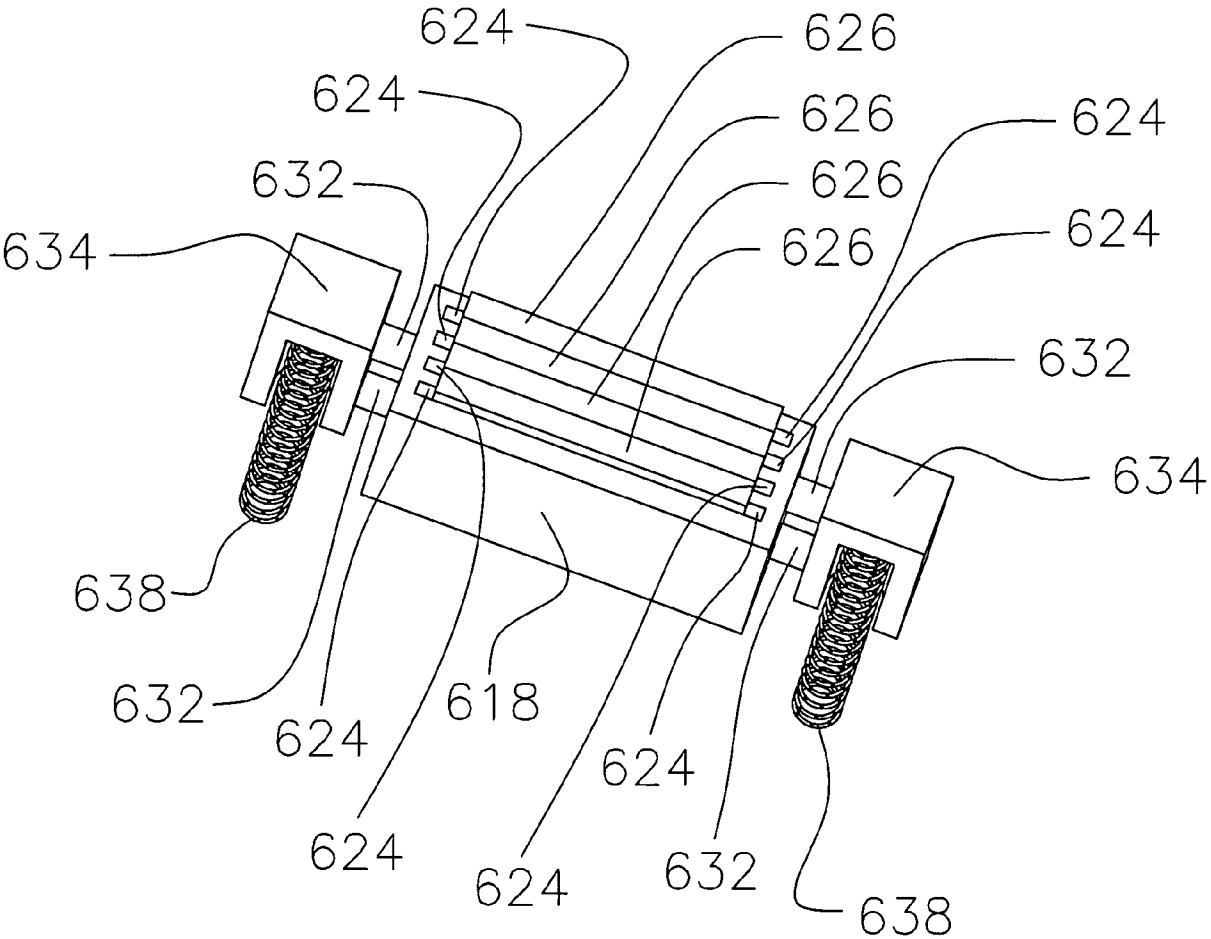
FIG. 28 is a front perspective view of the assembled latch bolt pin actuator of FIG. 27.

Each of the plates 626 includes two lateral tabs 628 that are dimensioned to be received in the notches 624 so that the plates 626 align with a front surface of the latch pin actuator, as seen in FIG. 28. The notches 624 are spaced approximately ⅛" from one another.

The alternative pin latch actuator 616 allows for the door latch actuator to adjust without having to modify the jamb. With reference to FIG. 27, with the spring latch bolt in the extended position, the flat surface of the spring latch bolt sits flush against a top flat surface of the uppermost plate 626. If the spring latch bolt does not extend fully into the latch opening, i.e., the spring latch bolt is caught by the latch pin actuator before extending fully, the door is not properly latched, thus the door can open. If the door and the jamb are not properly aligned, the jamb mounted door latch actuator 10, 210 or 410 could be misaligned with the door deadlatch lock assembly's spring latch bolt. Removal of one or a few plates 626 in the pin latch actuator 616 provides an adjustment which can allow the spring latch bolt to fully extend to properly latch the door.

The alternative latch pin actuator also includes four posts 632, similar to the posts 484 in the latch pin actuator 416 described above. Two posts 632 extend outwardly from each lateral wall 622 and attach to a spring retaining member 634 respectively. Each spring retaining member includes a channel 636 that can receive a spring 638 similar to the spring 482 described above.

The door latch actuator 410 also includes a circuit board 520 to control the movement of the motor 492. The circuit board can include switches, one example being toggle-type limit switches that can control the direction of rotation of the motor. In an alternative embodiment, the circuit board 520 can include sensors that can detect the position of the actuating element 498. For example, magnets can be located on one of the cams 500 and a sensor on or remotely connected to the circuit board can detect the location of the magnets and deliver appropriate instructions to the motor.

Each of the door latch actuators described above 10, 210 and 410 include a component or components that can cover the entire or substantially the entire latch opening. Such a design can inhibit either the spring latch bolt or the latch bolt pin of the deadlatch lock assembly from getting caught in the latch opening as the door is being opened. Furthermore, by covering the entire latch opening, if the deadlatch lock assembly of the door does not exactly fit into the latch cavity (i.e. some space exists so that there is some "play" in the door latch actuator), the spring latch bolt and the latch bolt pin of the deadlatch lock assembly are both retracted so that they can both clear the ledge of the doorjamb.

The door latch actuator has been described with some degree of particularity directed to preferred embodiments of the apparatus. For example, the door latch actuator has been described actuating a deadlatch lock assembly that includes both a spring latch bolt and a latch bolt pin; however, the door latch actuator can actuate an assembly that only includes a spring latch bolt. It should be appreciated that modifications and alterations will occur to those skilled in the art upon a reading and understanding of the preceding detailed description. Furthermore, directional terms, such as "upper" and "lower" and the like have been used to describe the figures and are not meant to limit the placement of the components of the door latch actuator to only those positions described. The present invention is defined by the claims that follow as well as all equivalents within the scope and spirit of the appended claims.

What is claimed is:

1. A door latch actuator comprising:

a housing including a strike plate defining a latch opening;

a spring latch bolt actuator movably mounted in said housing such that at least a portion of said spring latch bolt actuator moves in and out of the latch opening;

a biasing member attached to said housing and said spring latch bolt actuator adapted to bias said spring latch bolt actuator away from the latch opening; and a latch bolt pin actuator movably mounted in said housing such that at least a portion of said latch bolt pin actuator moves in and out of the latch opening.

2. The door latch actuator of claim 1, wherein said spring latch bolt actuator is pivotally mounted in said housing.

3. The door latch actuator of claim 1, further comprising a latch bolt pin biasing member adapted to bias said latch bolt pin actuator away from the latch opening.

4. The door latch actuator of claim 1, further comprising a latch bolt pin biasing member adapted to bias said latch bolt pin actuator towards the latch opening.

5. The door latch actuator of claim 1, wherein said spring latch bolt actuator includes a surface adapted to be received in the latch opening such that the surface is adjacent at least substantially an entire length of three sides of the latch opening.

6. The door latch actuator of claim 1, wherein said spring latch bolt actuator includes a surface adapted to cover substantially the entire latch opening.

7. The door latch actuator of claim 1, further comprising a motor and transmission for driving said spring latch bolt actuator and said latch bolt pin actuator.

8. The door latch actuator of claim 7, further comprising an actuating element adapted to move at least one of said latch bolt pin actuator and said spring latch bolt actuator.

9. A door latch actuator comprising:

a housing including a strike plate defining a latch opening adapted to receive a spring latch bolt and a latch bolt pin of an associated deadlatch lock assembly;

a latch bolt pin actuator mounted for linear movement in said housing towards and away from the latch opening in a direction generally perpendicular to the strike plate, wherein said latch bolt pin actuator is adapted to have an adjustable dimension; and a spring latch bolt actuator mounted for pivotal movement in said housing between an extended position and a retracted position.

10. The door latch actuator of claim 9, wherein said spring latch bolt actuator and said latch bolt pin actuator are adapted to move in relation to one another such that when said latch bolt pin actuator is in the second retracted position said spring latch bolt actuator is in the extended position.

11. The door latch actuator of claim 9, wherein said spring latch bolt actuator covers substantially the entire latch opening when said spring latch bolt actuator is in an extended position.

12. The door latch actuator of claim 9, further comprising a motor, wherein said spring latch bolt actuator and said latch bolt pin actuator are driven by said motor.

13. The door latch actuator of claim 12, further comprising an actuating element for moving at least one of said spring latch bolt actuator and said latch bolt pin actuator, wherein said motor drives said actuating element.

14. The door latch actuator of claim 12, further comprising an actuating element for moving said spring latch bolt actuator and said latch bolt pin actuator, wherein said motor drives said actuating element.

15. The door latch actuator of claim 9, further comprising a biasing member attached to said spring latch bolt actuator for biasing said spring latch bolt actuator toward the latch opening.

16. A door latch actuator comprising:

a housing including a strike plate defining a latch opening;

a spring latch bolt actuator movably mounted in said housing such that said spring latch bolt actuator moves between a first position wherein said spring latch bolt actuator is retracted in said housing and a second position wherein a portion of said spring latch bolt actuator is extended into the latch opening; and a latch bolt pin actuator movably mounted in said housing such that said latch bolt pin actuator moves between a first position wherein a portion of said latch bolt pin actuator is extended into the latch opening and a second position wherein said latch bolt pin actuator is retracted in said housing;

wherein at least one of said latch bolt pin actuator and said spring latch actuator at least substantially covers the entire latch opening when at least one of said latch bolt pin actuator and said spring latch actuator is in the extended position, and said latch bolt pin actuator moves in relation to said spring latch bolt actuator such that when said spring latch bolt actuator has moved from the first position to the second position and said latch bolt pin actuator has moved from the first position to the second position the portion of said spring latch bolt actuator extended into the latch opening occupies a space once occupied by the portion of said latch bolt pin actuator that was extended into the latch opening.

17. The door latch actuator of claim 16, wherein said spring latch bolt actuator pivots between the first position and the second position.

18. The door latch actuator of claim 16, wherein said latch bolt pin actuator linearly reciprocates between the first position and the second position.

19. A door latch actuator comprising:

a housing including a strike plate defining a latch opening adapted to receive a spring latch bolt and a latch bolt pin of an associated deadlatch lock assembly;

a latch bolt pin actuator mounted for linear movement in said housing between a first extended position and a second retracted position; and a spring latch bolt actuator mounted for pivotal movement in said housing between an extended position and a retracted position, wherein said spring latch bolt actuator covers substantially the entire latch opening when said spring latch bolt actuator is in an extended position.

20. A door latch actuator comprising:

a housing including a strike plate defining a latch opening adapted to receive a spring latch bolt and a latch bolt pin of an associated deadlatch lock assembly;

a latch bolt pin actuator mounted for linear movement in said housing towards and away from the latch opening in a direction generally perpendicular to the strike plate;

a spring latch bolt actuator mounted for pivotal movement in said housing between an extended position and a retracted position;

a motor, wherein said spring latch bolt actuator and said latch bolt pin actuator are driven by said motor; and an actuating element for moving said spring latch bolt actuator and said latch bolt pin actuator, wherein said motor drives said actuating element.

* * * * *